US008498852B2

(12) United States Patent
Xu et al.

(10) Patent No.: US 8,498,852 B2
(45) Date of Patent: Jul. 30, 2013

(54) METHOD AND APPARATUS FOR EFFICIENT REAL-TIME CHARACTERIZATION OF HYDRAULIC FRACTURES AND FRACTURING OPTIMIZATION BASED THEREON

(75) Inventors: Wenyue Xu, Dallas, TX (US); Marc Jean Thiercelin, Dallas, TX (US)

(73) Assignee: Schlumberger Tehcnology Corporation, Sugar Land, TX (US)

( * ) Notice: Subject to any disclaimer, the term of this patent is extended or adjusted under 35 U.S.C. 154(b) by 909 days.

(21) Appl. No.: 12/479,335

(22) Filed: Jun. 5, 2009

(65) Prior Publication Data

US 2010/0307755 A1 Dec. 9, 2010

(51) Int. Cl.
*G06G 7/48* (2006.01)

(52) U.S. Cl.
USPC ..... 703/10

(58) Field of Classification Search
USPC ..... 703/10, 12; 166/250.1; 367/35
See application file for complete search history.

(56) References Cited

U.S. PATENT DOCUMENTS

| | | | | |
|---|---|---|---|---|
| 4,834,181 | A * | 5/1989 | Uhri et al. | 166/281 |
| 7,486,589 | B2 * | 2/2009 | Lee et al. | 367/35 |
| 7,516,793 | B2 | 4/2009 | Dykstra | |
| 7,788,037 | B2 * | 8/2010 | Soliman et al. | 702/12 |
| 2005/0125209 | A1 * | 6/2005 | Soliman et al. | 703/10 |
| 2005/0171751 | A1 * | 8/2005 | Siebrits et al. | 703/10 |
| 2006/0219402 | A1 * | 10/2006 | Lecampion | 166/250.1 |
| 2007/0023184 | A1 * | 2/2007 | Jackson et al. | 166/250.07 |
| 2007/0193745 | A1 * | 8/2007 | Fulton et al. | 166/280.2 |
| 2007/0272407 | A1 | 11/2007 | Lehman et al. | |
| 2008/0164021 | A1 * | 7/2008 | Dykstra | 166/250.1 |
| 2008/0183451 | A1 | 7/2008 | Weng et al. | |
| 2008/0259727 | A1 | 10/2008 | Drew | |

OTHER PUBLICATIONS

B.R. Meyer, "Three-dimensional hydraulic fracturing simulation on personal computers: theory and comparison studies," 1989, Society of Petroleum Engineers, SPE 19329, pp. 1-12 and six pages of tables and figures.*

E. P. Lolon et al., "Application of 3-D reservoir simulator for hydraulically fractured wells," 2007, Society of Petroleum Engineers, SPE 110093, pp. 1-8.*

Michael J. Economides et al., "Petroleum Production Systems," 1994, Prentice-Hall, pp. 421-457.*

Peter Valko et al., "Hydraulic Fracture Mechanics," 1995, John Wiley & Sons, pp. 75, 189-265.*

(Continued)

*Primary Examiner* — Dwin M Craig
*Assistant Examiner* — Russ Guill
(74) *Attorney, Agent, or Firm* — Myron Stout; Daryl Wright

(57) ABSTRACT

Methods and systems for characterizing hydraulic fracturing of a subterranean formation based upon inputs from sensors measuring field data in conjunction with a fracture model. Such characterization can be generated in real-time to automatically manipulate surface and/or down-hole physical components supplying hydraulic fluids to the subterranean formation to adjust the hydraulic fracturing process as desired. The hydraulic fracture model as described herein can also be used as part of forward calculations to help in the design and planning stage of a hydraulic fracturing treatment. In a preferred embodiment, the fracture model constrains geometric and geomechanical properties of the hydraulic fractures of the subterranean formation using the field data in a manner that significantly reduce the complexity of the fracture model and thus significantly reduces the processing resources and time required to provide accurate characterization of the hydraulic fractures of the subterranean formation.

37 Claims, 8 Drawing Sheets

OTHER PUBLICATIONS

Wenyue Xu et al., "Characterization of Hydraulically-induced fracture network using treatment and microseismic data in a tight-gas formation: a geomechanical approach," Jun. 15, 2009, Society of Petroleum Engineers, five pages.*

M.J. Mayerhofer et al., "Integration of microseismic fracture mapping results with numerical fracture network production modeling in the Barnett shale," 2006, Society of Petroleum Engineers, SPE 102103, pp. 1-8.*

Warpinski, N.R., et al., Review of Hydraulic Fracture Mapping Using Advanced Accelerometer-Based Receiver Systems, Sandia National Laboratories, 1997, pp. 1-11.

StimMAP LIVE Monitoring Process—Microseismic Fracture Monitoring with Accurate Answers in Real Time, Schlumberger, 2008, 07-ST-137, pp. 1-12.

* cited by examiner

METHOD AND APPARATUS FOR EFFICIENT REAL-TIME CHARACTERIZATION OF HYDRAULIC FRACTURES AND FRACTURING OPTIMIZATION BASED THEREON

BACKGROUND OF THE INVENTION

1. Field of the Invention

The present invention relates generally to methods and systems for investigating subterranean formations. More particularly, this invention is directed to methods and systems for characterizing hydraulic fracture networks in a subterranean formation.

2. State of the Art

In order to improve the recovery of hydrocarbons from oil and gas wells, the subterranean formations surrounding such wells can be hydraulically fractured. Hydraulic fracturing is used to create cracks in subsurface formations to allow oil or gas to move toward the well. A formation is fractured by introducing a specially engineered fluid (referred to as "hydraulic fluid" herein) at high pressure and high flow rates into the formation through one or more wellbore. Hydraulic fractures typically extend away from the wellbore hundreds of feet in two opposing directions according to the natural stresses within the formation. Under certain circumstances they instead form a complex fracture network.

The hydraulic fluids are typically loaded with proppants, which are usually particles of hard material such as sand. The proppant collects inside the fracture to permanently "prop" open the new cracks or pores in the formation. The proppant creates a plane of high-permeability sand through which production fluids can flow to the wellbore. The hydraulic fluids are preferably of high viscosity, and therefore capable of carrying effective volumes of proppant material.

Typically, the hydraulic fluid is realized by a viscous fluid, frequently referred to as "pad" that is injected into the treatment well at a rate and pressure sufficient to initiate and propagate a fracture in hydrocarbon formation. Injection of the "pad" is continued until a fracture of sufficient geometry is obtained to permit placement of the proppant particles. After the "pad," the hydraulic fluid typically consists of a fracturing fluid and proppant material. The fracturing fluid may be a gel, an oil base, water base, brine, acid, emulsion, foam or any other similar fluid. The fracturing fluid can contain several additives, viscosity builders, drag reducers, fluid-loss additives, corrosion inhibitors and the like. In order to keep the proppant suspended in the fracturing fluid until such time as all intervals of the formation have been fractured as desired, the proppant should have a density close to the density of the fracturing fluid utilized. Proppants are typically comprised of any of the various commercially available fused materials such as silica or oxides. These fused materials can comprise any of the various commercially available glasses or high-strength ceramic products. Following the placement of the proppant, the well is shut-in for a time sufficient to permit the pressure to bleed off into the formation. This causes the fracture to close and exert a closure stress on the propping agent particles. The shut-in period may vary from a few minutes to several days.

Current hydraulic fracture monitoring methods and systems map where the fractures occur and the extent of the fractures. The methods and systems of microseismic monitoring process seismic event locations by mapping seismic arrival times and polarization information into three-dimensional space through the use of modeled travel times and/or ray paths. These methods and systems can be used to infer hydraulic fracture propagation over time.

Conventional hydraulic fracture models typically assume a bi-wing type induced fracture. They are short in representing the complex nature of induced fractures in some unconventional reservoirs with preexisting natural fractures such as the Barnett Shale and many other formations. Several recently published models map the complex geometry of discrete hydraulic fractures based on monitoring microseismic event distribution. They are typically not constrained by accounting for either the amount of pumped fluid or mechanical interactions both between fractures and injected fluid and among the fractures. Those few better constrained models have greatly improved our fundamental understanding of involved mechanisms. However, they are inevitably complex in mathematical description and often require substantial computer processing resources and time in order to provide accurate simulations of hydraulic fracture propagation.

SUMMARY OF THE INVENTION

The present application discloses methods and systems for characterizing hydraulic fracturing of a subterranean formation based upon inputs from sensors measuring field data in conjunction with a hydraulic fracture network model. The fracture model constrains geometric properties of the hydraulic fractures of the subterranean formation using the field data in a manner that significantly reduces the complexity of the fracture model and thus significantly reduces the processing resources and time required to provide accurate characterization of the hydraulic fractures of the subterranean formation. Such characterization can be generated in real-time to manually or automatically manipulate surface and/or down-hole physical components supplying hydraulic fluids to the subterranean formation to adjust the hydraulic fracturing process as desired, such as by optimizing fracturing plan for the site (or for other similar fracturing sites).

In some embodiments, the methods and systems of the present invention are used to design wellbore placement and hydraulic fracturing stages during the planning phase in order to optimize hydrocarbon production.

In some embodiments, the methods and systems of the present invention are used to adjust the hydraulic fracturing process in real-time by controlling the flow rates, compositions, and/or properties of the hydraulic fluid supplied to the subterranean formation.

In some embodiments, the methods and systems of the present invention are used to adjust the hydraulic fracturing process by modifying the fracture dimensions in the subterranean formation in real time.

The method and systems of the present invention afford many advantages over the prior art, including improved hydrocarbon production from a well, and improved results of subterranean fracturing (whereby the resulting fracture dimensions, directional positioning, orientation, and geometry, and the placement of a proppant within the fracture more closely resemble the desired results).

Additional objects and advantages of the invention will become apparent to those skilled in the art upon reference to the detailed description taken in conjunction with the provided figures.

DETAILED DESCRIPTION OF THE PREFERRED EMBODIMENTS

The present invention employs a model for characterizing a hydraulic fracture network as described below. Such a model includes a set of equations that quantify the complex physical process of fracture propagation in a formation driven by fluid injected through a wellbore. In the preferred embodiment, these equations are posed in terms of 12 model parameters: wellbore radius $x_w$ and wellbore net pressure $p_w-\sigma_c$, fluid injection rate q and duration $t_p$, matrix plane strain modulus E, fluid viscosity μ (or other fluid flow parameter(s) for non-Newtonian fluids), confining stress contrast Δσ, fracture network sizes h, a, e, and fracture spacing $d_x$ and $d_y$.

Figure 1:
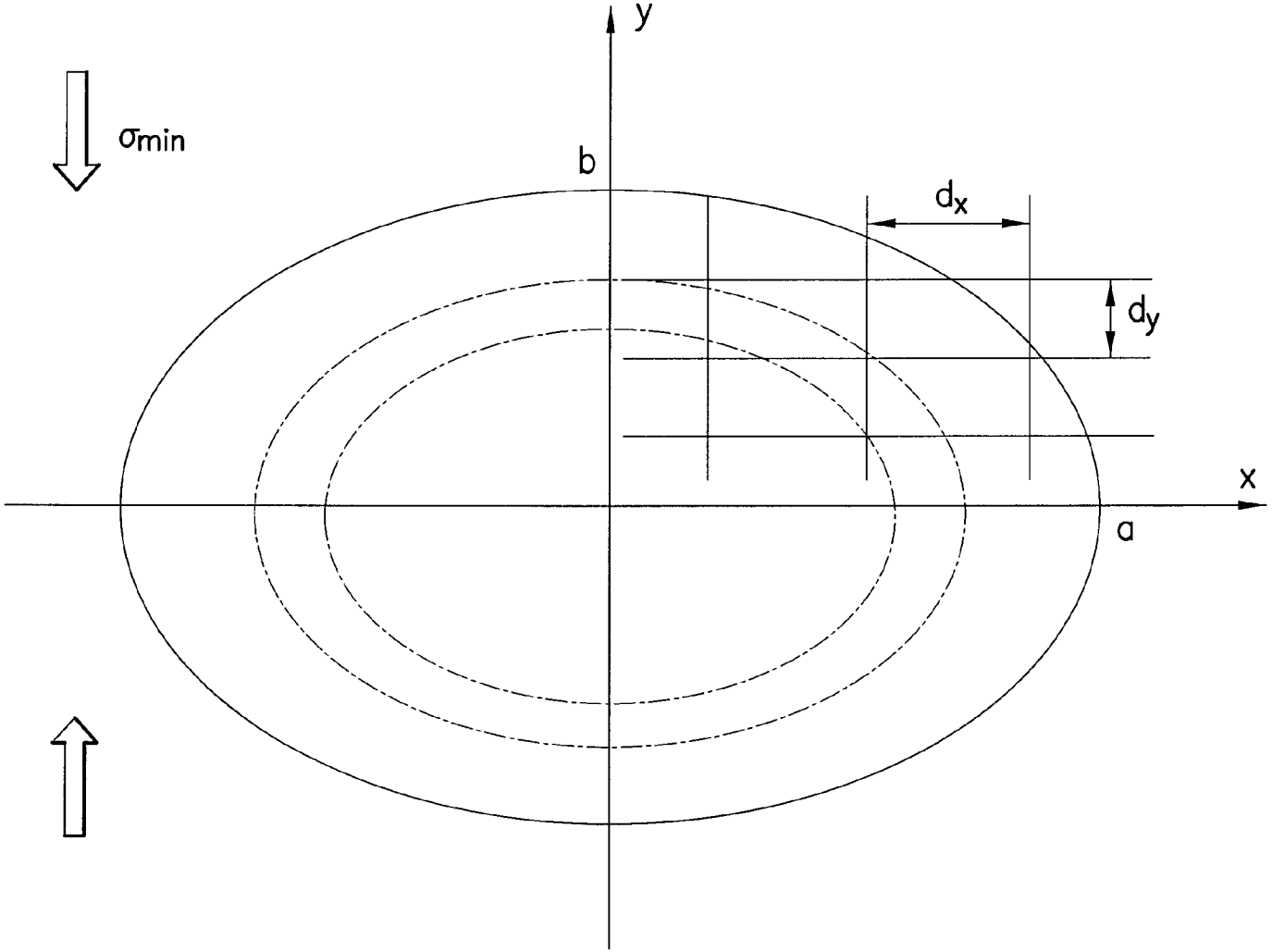
FIG. 1 is a pictorial illustration of the geometric properties of an exemplary hydraulic fracture model in accordance with the present invention.

A hydraulic fracture network can be produced by pumping fluid into a formation. A hydraulic fracture network can be represented by two perpendicular sets of parallel planar fractures. The fractures parallel to the x-axis are equally separated by distance $d_y$ and those parallel to the y-axis are separated by distance $d_x$ as illustrated in FIG. 1. Consequently, the numbers of fractures, per unit length, parallel to the x-axis and the y-axis, respectively, are $$n_x = \frac{1}{d_y} \text{ and } n_y = \frac{1}{d_x}. \tag{1}$$

The pumping of fracturing fluid over time produces a propagating fracture network that can be represented by an expanding volume in the form of an ellipse with height h, major axis a, minor axis b or aspect ratio $$e = \frac{b}{a}. \tag{2}$$

The governing equation for mass conservation of the injected fluid in the fractured subterranean formation is given by:

$$2\pi ex\frac{\partial(\phi\rho)}{\partial t} + 4\frac{\partial(Bx\rho\bar{v}_e)}{\partial x} = 0, \tag{3a}$$

$$\frac{2\pi y}{e}\frac{\partial(\phi\rho)}{\partial t} + 4\frac{\partial}{\partial y}\left(\frac{By\rho\bar{v}_e}{e}\right) = 0, \tag{3b}$$

which for an incompressible fluid becomes respectively $$2\pi ex\frac{\partial\phi}{\partial t} + 4\frac{\partial(Bx\bar{v}_e)}{\partial x} = 0, \tag{3c}$$

or $$\frac{2\pi y}{e}\frac{\partial\phi}{\partial t} + 4\frac{\partial}{\partial y}\left(\frac{By\bar{v}_e}{e}\right) = 0, \tag{3d}$$

where

φ is the porosity of the formation,

ρ is the density of injected fluid $\bar{v}_e$ is an average fluid velocity perpendicular to the elliptic boundary, and B is the elliptical integral given by $$B = \frac{\pi}{2}\left[1 - \left(\frac{1}{2}\right)^2(1-e^2) - \left(\frac{1\cdot 3}{2\cdot 4}\right)^2\frac{(1-e^2)^2}{3} - \left(\frac{1\cdot 3\cdot 5}{2\cdot 4\cdot 6}\right)^2\frac{(1-e^2)^3}{5} - \ldots\right]. \tag{4}$$

The average fluid velocity $\bar{v}_e$ may be approximated as $$\begin{aligned}\bar{v}_e &\approx \frac{1}{2}[v_{ex}(x, y=0) + v_{ey}(x=0, y=ex)] \\ &\approx \frac{1}{2}(1+e)v_{ex}(x, y=0) \\ &\approx \frac{1}{2}(1+1/e)v_{ey}(x=0, y=ex)\end{aligned} \tag{5}$$

with $$v_{ex}(x, y=0) = -\left[\frac{k_x}{\mu}\frac{\partial p}{\partial x}\right]_{(x,y=0)}, \tag{6a}$$

$$v_{ey}(x=0, y=ex) = -\left[\frac{k_y}{\mu}\frac{\partial p}{\partial y}\right]_{(x=0,y=ex)}, \tag{6b}$$

where

ρ is fluid pressure,

μ is fluid viscosity, and $k_x$ and $k_y$ are permeability factors for the formation along the x-direction and the y-direction, respectively.

For the sake of mathematical simplicity, equations below are presented for an incompressible fluid as an example, with the understanding that it is rather easy to account for fluid compressibility using the corresponding equation of state for the injected fluid.

Using equations (5) and (6), governing equation (3) can be written as $$2\pi ex\frac{\partial\phi}{\partial t} - 2\frac{\partial}{\partial x}\left(\frac{B(1+e)xk_x}{\mu}\frac{\partial p}{\partial x}\right) = 0, \tag{7a}$$

or $$\frac{2\pi y}{e}\frac{\partial\phi}{\partial t} - 2\frac{\partial}{\partial y}\left(\frac{B(1+e)yk_y}{e^2\mu}\frac{\partial p}{\partial y}\right) = 0. \tag{7b}$$

The width w of a hydraulic fracture may be calculated as $$w = \frac{2l}{E}(p-\sigma_c)H(p-\sigma_c), \tag{8}$$

-continued $$H(p-\sigma_c)=\begin{cases}0 & p\le\sigma_c\\ 1 & p>\sigma_c\end{cases}$$

where

H is the Heaviside step function, $\sigma_c$ is the confining stress perpendicular to the fracture, E is the plane strain modulus of the formation, and l is the characteristic length scale of the fracture segment and given by the expression $$l=d+(h-d)H(d-h) \tag{9}$$

where h and d are the height and the length, respectively, of the fracture segment.

When mechanical interaction between adjacent fractures is accounted for, assuming that the size of stimulated formation is much larger than either the height of the ellipse or the averaged length of fractures, the width of fractures parallel to the x-axis and the y-axis, respectively, can be expressed as $$w_x=\frac{2d_x}{A_{Ex}E}(p-\sigma_{cy})H(p-\sigma_{cy}), \tag{10a}$$

$$w_y=\frac{2d_y}{A_{Ey}E}(p-\sigma_{cx})H(p-\sigma_{cx}) \tag{10b}$$

where $\sigma_{cx}$ and $\sigma_{cy}$ are the confining stresses, respectively, along the x-direction and the y-direction, respectively, and $A_{Ex}$ and $A_{Ey}$ are the coefficients for defining the effective plane strain modulus along the x-axis and y-axis, respectively.

For complex fracture networks the coefficients $A_{Ex}$ and $A_{Ey}$ may be approximately represented by the following expressions $$A_{Ex}=\frac{d_x[2l_x+(d_y-2l_x)H(d_y-2l_x)]}{d_y l_x}, \tag{11a}$$

$$A_{Ey}=\frac{d_y[2l_y+(d_x-2l_y)H(d_x-2l_y)]}{d_x l_y}. \tag{11b}$$

where $l_x$ and $l_y$ are the characteristic length scale along the x-axis and the y-axis, respectively.

The value of the coefficient ($A_{Ex}$) for the effective plane strain modulus along the x-axis can be simplified for different cases of $d_x$, $d_y$, and h by any one of Tables 1-2 listed below. The value of the coefficient ($A_{Ey}$) for the effective plane strain modulus along the y-axis can be simplified for different cases of $d_x$, $d_y$, and h by any one of Tables 3-5 listed below.

TABLE 1

Coefficient $A_{Ex}$ for different cases of $d_x$, $d_y$, h

| $A_{Ex}$ | | | | | | |
|---|---|---|---|---|---|---|
| $d_x \geqq d_y$ | | | $d_x < d_y$ | | | |
| $d_x \leqq h$ | $d_x > h$ | | $d_x \leqq h$ | | $d_x > h$ | |
| $\frac{2d_x}{d_y}$ | $d_y \leqq 2h$ | $d_y > 2h$ | $d_y \leqq 2d_x$ | $d_y > 2d_x$ | $d_y \leqq 2h$ | $d_y > 2h$ |
| | $\frac{2d_x}{d_y}$ | $\frac{d_x}{h}$ | $\frac{2d_x}{d_y}$ | 1 | $\frac{2d_x}{d_y}$ | $\frac{d_x}{h}$ |

TABLE 2

Coefficient $A_{Ex}$ for different cases of $d_x$, $d_y$, h

| $A_{Ex}$ | | | | | | |
|---|---|---|---|---|---|---|
| $d_x \geqq d_y$ | | | $d_x < d_y$ | | | |
| $d_x \leqq h$ | $d_x > h$ | | $d_y \leqq h$ | | $d_y > h$ | |
| $\frac{2d_x}{d_y}$ | $d_y \leqq 2h$ | $d_y > 2h$ | $d_y \leqq 2d_x$ | $d_y > 2d_x$ | $d_y \leqq 2h$ | $d_y > 2h$ |
| | $\frac{2d_x}{d_y}$ | $\frac{d_x}{h}$ | $\frac{2d_x}{d_y}$ | 1 | $\frac{2d_x}{d_y}$ | $\frac{d_x}{h}$ |

TABLE 3

Coefficient $A_{Ey}$ for different cases of $d_x$, $d_y$, h

| $A_{Ey}$ | | | | | | |
|---|---|---|---|---|---|---|
| $d_y \geqq d_x$ | | | $d_y < d_x$ | | | |
| $d_y \leqq h$ | $d_y > h$ | | $d_y \leqq h$ | | $d_y > h$ | |
| $\frac{2d_y}{d_x}$ | $d_x \leqq 2h$ | $d_x > 2h$ | $d_x \leqq 2d_y$ | $d_x > 2d_y$ | $d_x \leqq 2h$ | $d_x > 2h$ |
| | $\frac{2d_y}{d_x}$ | $\frac{d_y}{h}$ | $\frac{2d_y}{d_x}$ | 1 | $\frac{2d_y}{d_x}$ | $\frac{d_y}{h}$ |

TABLE 4

Coefficient $A_{Ey}$ for different cases of $d_x$, $d_y$, h

| $A_{Ey}$ | | | | | | | | | | | | |
|---|---|---|---|---|---|---|---|---|---|---|---|---|
| $d_x \geqq d_y$ | | | | | | | $d_x < d_y$ | | | | | |
| $d_x \leqq h$ | | $d_x > h$ | | | | | $d_x \leqq h$ | | | | $d_x > h$ | |
| $d_x \leqq 2d_y$ | $d_x > 2d_y$ | $d_y \leqq h$ | | $d_y > h$ | | | $d_y \leqq h$ | | $d_y > h$ | | $d_x > 2h$ | $d_x > 2h$ |
| $\frac{2d_y}{d_x}$ | 1 | $d_x \leqq 2d_y$ $\frac{2d_y}{d_x}$ | $d_x > 2d_y$ 1 | $d_x \leqq 2h$ $\frac{2d_y}{d_x}$ | $d_x > 2h$ $\frac{d_y}{h}$ | | $d_x \leqq 2d_y$ $\frac{2d_y}{d_x}$ | $d_x > 2d_y$ 1 | $d_x \leqq 2h$ $\frac{2d_y}{d_x}$ | $d_x > 2h$ $\frac{d_y}{h}$ | $\frac{2d_y}{d_x}$ | $\frac{d_y}{h}$ |

TABLE 5

Coefficient $A_{Ey}$ for different cases of $d_x$, $d_y$, h

| $A_{Ey}$ | | | | | | | | |
|---|---|---|---|---|---|---|---|---|
| $d_x \geqq d_y$ | | | | | | $d_x < d_y$ | | |
| $d_x \leqq h$ | | $d_x > h$ | | | | $d_x \leqq h$ | $d_x > h$ | |
| $d_x \leqq 2d_y$ | $d_x > 2d_y$ | $d_y \leqq h$ | | $d_y > h$ | | $\frac{2d_y}{d_x}$ | $d_x \leqq 2h$ | $d_x > 2h$ |
| $\frac{2d_y}{d_x}$ | 1 | $d_x \leqq 2d_y$ | $d_x > 2d_y$ | $d_x \leqq 2h$ | $d_x > 2h$ | | $\frac{2d_y}{d_x}$ | $\frac{d_y}{h}$ |
| | | $\frac{2d_y}{d_x}$ | 1 | $\frac{2d_y}{d_x}$ | $\frac{d_y}{h}$ | | | |

The increase in porosity of the fractured formation ($\Delta\phi$) can be calculated as $$\Delta\phi = n_x w_x + n_y w_y - n_x n_y w_x w_y \approx \frac{2d_x}{d_y A_{Ex} E}(p-\sigma_{cy})H(p-\sigma_{cy}) + \frac{2d_y}{d_x A_{Ey} E}(p-\sigma_{cx})H(p-\sigma_{cx}) \tag{12}$$

The fracture permeability along the x-axis ($k_x$) and the fracture permeability along the y-axis ($k_y$) can be determined as $$k_x = \frac{n_x w_x^3}{12} = \frac{2d_x^3}{3E^3 d_y A_{Ex}^3}(p-\sigma_{cy})^3 H(p-\sigma_{cy}), \tag{13a}$$

and $$k_y = \frac{n_y w_y^3}{12} = \frac{2d_y^3}{3E^3 d_x A_{Ey}^3}(p-\sigma_{cx})^3 H(p-\sigma_{cx}), \tag{13b}$$

along the x-axis and y-axis, respectively.

For $p>\sigma_{cy}$ and a negligible virgin formation permeability as compared to the fracture permeability along the x-axis, the governing equation (7a) can be integrated from $x_w$ to x using equation (13a) for the permeability ($k_x$) to yield $$4(p-\sigma_{cy})^3 \frac{dp}{dx} = \frac{3A_{Ex}^3 d_y E^3 \mu}{(1+e)Bd_x^3 x}\left(2\pi \int_{x_w}^{x} \frac{\partial\phi}{\partial t} es\,ds - q\right). \tag{14a}$$

Similarly for $p>\sigma_{cx}$, the governing equation (7b) can be integrated from $x_w$ to y using equation (12b) for the permeability ($k_y$) to yield $$4(p-\sigma_{cx})^3 \frac{dp}{dy} = \frac{3e^2 A_{Ey}^3 d_x E^3 \mu}{(1+e)Bd_y^3 y}\left(2\pi \int_{x_w}^{y} \frac{\partial\phi}{\partial t} \frac{s}{e}\,ds - q\right). \tag{14b}$$

In equations (13a) and (13b), $x_w$ is the radius of the wellbore and q is the rate of fluid injection into the formation via the wellbore. The inject rate q is treated as a constant and quantified in volume per unit time per unit length of the wellbore.

Equation (14a) can be integrated from x to a and yields a solution for the net pressure inside the fracture along the x-axis as $$p-\sigma_{cy} = \left[\frac{3}{\left(\frac{1+}{e}\right)B}\int_x^a \frac{A_{Ex}^3 d_y E^3 \mu}{d_x^3 r}\left(q - 2\pi\int_{x_w}^{r} \frac{\partial\phi}{\partial t} es\,ds\right)dr\right]^{1/4}. \tag{15a}$$

Equation (14b) can be integrated from y to b yields a solution for the net pressure inside the fractures along the y-axis as $$p-\sigma_{cx} = \left[\frac{3e^2}{\left(\frac{1+}{e}\right)B}\int_y^b \frac{A_{Ey}^3 d_x E^3 \mu}{d_y^3 r}\left(q - 2\pi\int_{x_w}^{r} \frac{\partial\phi}{\partial t} \frac{s}{e}\,ds\right)dr\right]^{1/4}. \tag{15b}$$

For uniform $\sigma_c$, E, $\mu$, n and d, equation (15a) reduces to $$p-\sigma_{cy} = A_{px}\left[q\ln\left(\frac{a}{x}\right) - 2\pi e\int_x^a\left(\int_{x_w}^{r} \frac{\partial\phi}{\partial t} s\,ds\right)\frac{1}{r}\,dr\right]^{1/4} \tag{16a}$$

$$A_{px} = \left(\frac{3A_{Ex} d_y E^3 \mu}{(1+e)Bd_x^3}\right)^{1/4}.$$

Similarly, equation (15b) reduces to $$p-\sigma_{cx} = e^{1/2} A_{py}\left[q\ln\left(\frac{b}{y}\right) - \frac{2\pi}{e}\int_y^b\left(\int_{x_w}^{r} \frac{\partial\phi}{\partial t} s\,ds\right)\frac{1}{r}\,dr\right]^{1/4} \tag{16b}$$

$$A_{py} = \left(\frac{3A_{Ey}^3 d_x E^3 \mu}{(1+e)Bd_y^3}\right)^{1/4}.$$

The wellbore pressure $p_w$ is given by the following expressions:

$$p_w = \sigma_{cy} + A_{px}\left[q\ln\left(\frac{a}{x_w}\right) - 2\pi e\int_{x_w}^a\left(\int_{x_w}^{r} \frac{\partial\phi}{\partial t} s\,ds\right)\frac{1}{r}\,dr\right]^{1/4}, \tag{17a}$$

-continued $$p_w = \sigma_{cx} + e^{1/2}A_{py}\left[q\ln\left(\frac{b}{x_w}\right) - \frac{2\pi}{e}\int_{x_w}^{b}\left(\int_{x_w}^{r}\frac{\partial\phi}{\partial t}s\,ds\right)\frac{1}{r}\,dr\right]^{1/4}. \tag{17b}$$

By requiring the two expressions (17a, 17b) for the wellbore pressure $p_w$ to be equal, one obtains the difference between confining stresses ($\Delta\sigma_c$), which is also referred herein to as stress contrast $\Delta\sigma_c$, as $$\begin{aligned}\Delta\sigma_c &= \sigma_{cx} - \sigma_{cy} \\ &= A_{px}\left[q\ln\left(\frac{a}{x_w}\right) - 2\pi e\int_{x_w}^{a}\left(\int_{x_w}^{r}\frac{\partial\phi}{\partial t}s\,ds\right)\frac{1}{r}\,dr\right]^{1/4} - \\ &\quad e^{1/2}A_{py}\left[q\ln\left(\frac{ea}{x_w}\right) - \frac{2\pi}{e}\int_{x_w}^{ea}\left(\int_{x_w}^{r}\frac{\partial\phi}{\partial t}s\,ds\right)\frac{1}{r}\,dr\right]^{1/4}.\end{aligned} \tag{18}$$

Assuming negligible leakoff and incompressible fluid, the time $t_p$ for the ellipse edge propagating from $x_w$ to a along the x-axis and $x_w$ to b along the y-axis is determined as $$\begin{aligned}\frac{qt_p}{\pi} &= e\int_{x_w}^{a}\Delta\phi_x x\,dx + \frac{1}{e}\int_{x_w}^{b}\Delta\phi_y y\,dy \\ &= e\int_{x_w}^{a}\frac{2d_x(p_x-\sigma_{cy})}{d_yA_{Ex}E}x\,dx + \\ &\quad e\int_{x_w}^{x_\sigma}\frac{2d_y(p_x-\sigma_{cx})}{d_xA_{Ey}E}x\,dx + \\ &\quad \frac{1}{e}\int_{x_\sigma}^{b}\left[\frac{2d_x(p_y-\sigma_{cy})}{d_yA_{Ex}E} + \frac{2d_y(p_y-\sigma_{cx})}{d_xA_{Ey}E}\right]y\,dy,\end{aligned} \tag{19a}$$

or $$\begin{aligned}\frac{qt_p}{\pi e} &= \int_{x_w}^{a}[\Delta\phi_x(x) + \Delta\phi_y(y=ex)]x\,dx \\ &= \frac{2}{E}\left[\int_{x_w}^{x_\sigma}\left(\frac{d_x}{d_yA_{Ex}} + \frac{d_y}{d_xA_{Ey}}\right)(p_x-\sigma_{cy})x\,dx + \int_{x_\sigma}^{a}\frac{d_x}{d_yA_{Ex}}(p_x-\sigma_{cy})x\,dx\right] + \\ &\quad \frac{2}{E}\int_{x_w}^{a}\left(\frac{d_x}{d_yA_{Ex}} + \frac{d_y}{d_xA_{Ey}}\right)(p_y-\sigma_{cx})x\,dx + \\ &\quad \frac{2\Delta\sigma_c}{E}\left(\int_{x_w}^{a}\frac{d_x}{d_yA_{Ex}}x\,dx - \int_{x_w}^{x_\sigma}\frac{d_y}{d_xA_{Ey}}x\,dx\right),\end{aligned} \tag{19b}$$

where $x_\sigma$ is defined as $x_w \leqq x_\sigma < a$ where $$p \leqq \sigma_{cx} \text{ if } x \leqq x_\sigma,$$

$$p > \sigma_{cx} \text{ if } x > x_\sigma,$$

$$p = \sigma_{cx} \text{ if } x = x_\sigma. \tag{19c}$$

Equation (15a) can be rewritten for the case $p=\sigma_{cx}$ at $x=x_\sigma$ as follows $$\Delta\sigma_c = \left[\frac{3}{(1+e)B}\int_{x_\sigma}^{a}\frac{A_{Ex}^3 d_y E^3\mu}{d_x^3 r}\left(q - 2\pi\int_{x_w}^{r}\frac{\partial\phi}{\partial t}es\,ds\right)dr\right]^{1/4}. \tag{20}$$

The surface area of the open fractures may be calculated as follows $$S \approx \pi ab \times 2hn_x + \pi x_\sigma b \times 2hn_y, \tag{21}$$

-continued $$= 2\pi eah\left(\frac{a}{d_y} + \frac{x_\sigma}{d_x}\right).$$

For a quasi-steady state, governing equations (7a) and (7b) reduce to $$-2B(1+e)\frac{xk_x}{\mu}\frac{dp}{dx} = q, \tag{22a}$$

$$-\frac{2B(1+e)}{e^2}\frac{yk_y}{\mu}\frac{dp}{dy} = q. \tag{22b}$$

Moreover, for the quasi-steady state, the pressure equations (15a) and (15b) reduce to $$p - \sigma_{cy} = \left[\frac{3}{(1+e)B}\int_{x}^{a}\frac{A_{Ex}^3 d_y E^3 q\mu}{d_x^3 r}\,dr\right]^{1/4}, \tag{23a}$$

$$p - \sigma_{cx} = \left[\frac{3e^2}{(1+e)B}\int_{y}^{b}\frac{A_{Ey}^3 d_x E^3 q\mu}{d_y^3 r}\,dr\right]^{1/4}. \tag{23b}$$

For the quasi-steady state and uniform properties of $\sigma_c$, E, μ, n and d, equations (16a) and (16b) reduce to $$p - \sigma_{cy} = A_{px}\left(q\ln\frac{a}{x}\right)^{1/4}, \tag{24a}$$

$$p - \sigma_{cx} = e^{1/2}A_{py}\left(q\ln\frac{b}{y}\right)^{1/4}. \tag{24b}$$

Correspondingly, for the quasi-steady state, the wellbore pressure equations (17a) and (17b) reduce to $$p_w = \sigma_{cy} + A_{px}\left(q\ln\frac{a}{x_w}\right)^{1/4}, \tag{25a}$$

$$p_w = \sigma_{cx} + e^{1/2}A_{py}\left(q\ln\frac{ea}{x_w}\right)^{1/4}. \tag{25b}$$

By requiring the two expressions (25a, 25b) for the wellbore pressure $p_w$ to be equal, one obtains $$\left[1 - e^{1/2}A_{ea}\frac{d_x}{d_y}\left(\frac{A_{Ey}}{A_{Ex}}\right)^{3/4}\right](p_w - \sigma_{cy}) = \Delta\sigma_c, \tag{26}$$

$$A_{ea} = \left[\frac{\ln(ea/x_w)}{\ln(a/x_w)}\right]^{1/4}.$$

For the quasi-steady state and uniform properties of $\sigma_c$, E, μ, n and d, equations (19a) and (19b), respectively, reduce to $$\begin{aligned}\frac{qt_p}{\pi} = {} & \frac{eA_\phi d_y^{1/4}A_{Ex}^{3/4}}{d_x^{3/4}}\left[\left(\frac{d_x}{d_yA_{Ex}} + \frac{d_y}{d_xA_{Ey}}\right)\int_{x_w}^{x_\sigma}\left(\ln\frac{a}{x}\right)^{1/4}x\,dx + \frac{d_x}{d_yA_{Ex}}\int_{x_\sigma}^{a}\left(\ln\frac{a}{x}\right)^{1/4}x\,dx\right] + \\ & \frac{A_\phi d_x^{1/4}A_{Ey}^{3/4}}{e^{1/2}d_y^{3/4}}\left(\frac{d_x}{d_yA_{Ex}} + \frac{d_y}{d_xA_{Ey}}\right)\int_{x_w}^{b}\left(\ln\frac{b}{y}\right)^{1/4}y\,dy + \\ & \frac{\Delta\sigma_c}{E}\left[\frac{d_x}{ed_yA_{Ex}}(b^2 - x_w^2) - \frac{ed_y}{d_xA_{Ey}}(x_\sigma^2 - x_w^2)\right],\end{aligned} \tag{27a}$$

$$A_\phi = \left[\frac{48q\mu}{(1+e)BE}\right]^{1/4},$$

and $$\begin{aligned}\frac{qt_p}{\pi e} = {} & A_\phi\left(\frac{d_yA_{Ex}^3}{d_x^3}\right)^{1/4}\left[\left(\frac{d_x}{d_yA_{Ex}} + \frac{d_y}{d_xA_{Ey}}\right)\int_{x_w}^{x_\sigma}\left(\ln\frac{a}{x}\right)^{1/4}x\,dx + \frac{d_x}{d_yA_{Ex}}\int_{x_\sigma}^{a}\left(\ln\frac{a}{x}\right)^{1/4}x\,dx\right] + \\ & e^{1/2}A_\phi\left(\frac{d_xA_{Ey}^3}{d_y^3}\right)^{1/4}\left(\frac{d_x}{d_yA_{Ex}} + \frac{d_y}{d_xA_{Ey}}\right)\int_{x_w}^{x_\sigma}\left(\ln\frac{a}{x}\right)^{1/4}x\,dx + \\ & \frac{\Delta\sigma_c}{E}\left[\frac{d_x}{d_yA_{Ex}}(a^2 - x_w^2) - \frac{d_y}{d_xA_{Ey}}(x_\sigma^2 - x_w^2)\right],\end{aligned} \tag{27b}$$

$$A_\phi = \left[\frac{48q\mu}{(1+e)BE}\right]^{1/4}.$$

Correspondingly, equation (20) can be solved to yield $$x_\sigma = a\exp\left[-\frac{1}{q}\left(\frac{\Delta\sigma_c}{A_{px}}\right)^4\right]. \tag{28}$$

The integrations in equation (27) can be numerically evaluated rather easily for a given $x_\sigma$.

Constraints on the Parameters of the Model Using Field Data

In general, given the rest of them, equations (25a), (26) and (27) can be solved to obtain any three of the model parameters. Certain geometric and geomechanical parameters of the model as described above can be constrained using field data from a fracturing treatment and associated microseismic events. In the preferred embodiment, the geometric properties ($d_x$ and $d_y$) and the stress contrast ($\Delta\sigma_c$) are constrained given wellbore radius $x_w$ and wellbore net pressure $p_w-\sigma_c$, fluid injection rate q and duration $t_p$, matrix plane strain modulus E, fluid viscosity μ, and fracture network sizes h, a, e, as follows. Note that since $x_\sigma$ in equation (27) is calculated using equation (28) as a function of $\Delta\sigma_c$, the solution procedure is necessarily of an iterative nature.

Given these values, the value of $d_x^3/(A_{Ex}^3 d_y)$ is determined according to equation (25a) by $$\frac{d_x^3}{A_{Ex}^3 d_y} = d_0^2 \tag{29}$$

$$d_0 = \left[\frac{3E^3q\mu\ln(a/x_w)}{(p_w - \sigma_{cy})^4(1+e)B}\right]^{1/2},$$

If ($2d_y \geqq d_x \geqq d_y$) and ($d_x \leqq h$), equation (29) leads to $$d_y = \sqrt{8}d_0. \tag{30}$$

Equations (26) and (27) become, respectively, $$\left[1 - A_{ea}\left(\frac{ed_y}{d_x}\right)^{1/2}\right](p_w - \sigma_{cy}) = \Delta\sigma_c, \tag{31}$$

and $$\begin{aligned}\frac{qt_a}{\pi} = {} & \frac{eA_\phi}{2^{1/4}d_y^{1/2}}\left[2\int_{x_w}^{x_\sigma}\left(\ln\frac{a}{x}\right)^{1/4}x\,dx + \int_{x_\sigma}^{a}\left(\ln\frac{a}{x}\right)^{1/4}x\,dx\right] + \\ & \frac{2^{3/4}A_\phi}{e^{1/2}d_x^{1/2}}\int_{x_w}^{b}\left(\ln\frac{b}{y}\right)^{1/4}y\,dy + \\ & \frac{\Delta\sigma_c}{2E}\left[\frac{b^2 - x_w^2}{e} - e(x_\sigma^2 - x_w^2)\right].\end{aligned} \tag{32}$$

Using solution (30), equations (31) and (32) can be solved to obtain $$\begin{aligned}\Delta\sigma_c = \Bigg\{ & \frac{qt_a}{\pi} - \frac{eA_\phi}{2^{1/4}d_y^{1/2}}\left[2\int_{x_w}^{x_\sigma}\left(\ln\frac{a}{x}\right)^{1/4}x\,dx + \int_{x_\sigma}^{a}\left(\ln\frac{a}{x}\right)^{1/4}x\,dx\right] - \\ & \frac{2^{3/4}A_\phi}{e^{1/2}d_x^{1/2}}\int_{x_w}^{b}\left(\ln\frac{b}{y}\right)^{1/4}y\,dy\Bigg\}\frac{2eE}{b^2 - x_w^2 - e^2(x_\sigma^2 - x_w^2)},\end{aligned} \tag{33}$$

-continued and $$d_x = \sqrt{8}\, d_0 e A_{ea}^2 \left( \frac{p_w - \sigma_{cy}}{p_w - \sigma_{cy} - \Delta\sigma_c} \right)^2. \tag{34}$$

If ($h \geqq d_x > 2d_y$), equations (26) and (27) become, respectively, $$\left[ 1 - \frac{e^{1/2}}{2^{3/4}} A_{ea} \left( \frac{d_x}{d_y} \right)^{1/4} \right] (p_w - \sigma_{cy}) = \Delta\sigma_c, \tag{35}$$

and $$\frac{qt_a}{\pi} = \frac{2^{3/4} e A_\phi}{d_y^{1/2}} \left[ \left( \frac{1}{2} + \frac{d_y}{d_x} \right) \int_{x_w}^{x_\sigma} \left( \ln \frac{a}{x} \right)^{1/4} x dx + \frac{1}{2} \int_{x_\sigma}^{a} \left( \ln \frac{a}{x} \right)^{1/4} x dx \right] + \frac{A_\phi d_x^{1/4}}{e^{1/2} d_y^{3/4}} \left( \frac{1}{2} + \frac{d_y}{d_x} \right) \int_{x_w}^{b} \left( \ln \frac{b}{y} \right)^{1/4} y dy + \frac{\Delta\sigma_c}{E} \left[ \frac{1}{2e} (b^2 - x_w^2) - \frac{e d_y}{d_x} (x_\sigma^2 - x_w^2) \right]. \tag{36}$$

Combined with solution (30) and replacing $\Delta\sigma_c$ with equation (35), equation (36) can be solved for $d_x$. $\Delta\sigma_c$ can then be calculated using equation (35).

If ($d_x > h \geqq d_y$), equation (29) leads to solution (30). Furthermore, if ($d_x \leqq 2d_y$), equations (26) and (27) lead to solutions (33) and (34). On the other hand, if ($d_x > 2d_y$), equations (26) and (27) lead to equations (35) and (36).

If ($d_x \geqq d_y$) and ($h < d_y \leqq 2h$), equation (29) leads to solution (30). Furthermore, if ($d_x \leqq 2h$), equations (26) and (27) lead to solutions (33) and (34). On the other hand, if ($d_x > 2h$), equations (26) and (27) become, respectively, $$\left[ 1 - A_{ea} \left( \frac{8e^2 d_0^2 d_x}{h^3} \right)^4 \right] (p_w - \sigma_{cy}) = \Delta\sigma_c, \tag{37}$$

and $$\frac{qt_a}{2\pi e} = \frac{A_\phi}{2d_0^{1/2}} \left[ \left( 1 + \frac{2h}{d_x} \right) \int_{x_w}^{x_\sigma} \left( \ln \frac{a}{x} \right)^{1/4} x dx + \int_{x_\sigma}^{a} \left( \ln \frac{a}{x} \right)^{1/4} x dx \right] - \frac{h(x_\sigma^2 - x_w^2)(p_w - \sigma_{cy})}{E d_x} \left[ 1 - \left( \frac{8e^2 d_0^2 d_x}{h^3} \right)^4 \right]. \tag{38}$$

Equation (38) can be solved for $d_x$ and then $\Delta\sigma_c$ can be calculated by equation (37).

If ($d_x \geqq d_y > 2h$), equation (29) leads to $$d_y = \frac{h^3}{d_0^2}. \tag{39}$$

Equations (26) and (27) becomes, respectively, $$\left[ 1 - e^{1/2} A_{ea} \left( \frac{d_0^2 d_x}{h^3} \right)^{7/4} \right] (p_w - \sigma_{cy}) = \Delta\sigma_c, \tag{40}$$

-continued and $$\frac{qt_a}{2\pi e} = \frac{A_\phi d_0^{3/2}}{h^2} \left[ \left( 1 + \frac{h^3}{d_0^2 d_x} \right) \int_{x_w}^{x_\sigma} \left( \ln \frac{a}{x} \right)^{1/4} x dx + \int_{x_\sigma}^{a} \left( \ln \frac{a}{x} \right)^{1/4} x dx \right] - \frac{h(x_\sigma^2 - x_w^2)(p_w - \sigma_{cy})}{E d_x} \left[ 1 - e^{1/2} \left( \frac{d_0^2 d_x}{h^3} \right)^{7/4} \right]. \tag{41}$$

Equation (41) can be solved for $d_x$ and then $\Delta\sigma_c$ can be calculated by equation (40).

If ($d_x < d_y \leqq 2d_x$) and ($d_x \leqq h$), equations (29), (26) and (27) lead to solutions (30), (33) and (34).

If ($d_y > 2d_x$) and ($d_x \leqq h$), equations (29), (26) and (27) become, respectively, $$d_x^3 = d_0^2 d_y, \tag{42}$$

$$\left[ 1 - 2^{3/4} A_{ea} \left( \frac{e d_0}{d_x} \right)^{1/2} \right] (p_w - \sigma_{cy}) = \Delta\sigma_c, \tag{43}$$

and $$\frac{qt_a}{2\pi e} = \frac{A_\phi d_0^{3/2}}{d_x^2} \left[ \left( 1 + \frac{d_x^2}{2d_0^2} \right) \int_{x_w}^{x_\sigma} \left( \ln \frac{a}{x} \right)^{1/4} x dx + \int_{x_\sigma}^{a} \left( \ln \frac{a}{x} \right)^{1/4} x dx \right] - \frac{(x_\sigma^2 - x_w^2)\Delta\sigma_c}{2E}. \tag{44}$$

Equations (42), (43) and (44) can be solved for $d_x$, $d_y$ and $\Delta\sigma_c$.

If ($h < d_x < d_y \leqq 2h$), equations (29), (26) and (27) lead to solutions (30), (33) and (34).

If ($h < d_x \leqq 2h < d_y$), equation (29) leads to solution (39). Equations (26) and (27) become respectively $$\left[ 1 - 2^{3/4} e^{1/2} A_{ea} \left( \frac{d_0}{d_x} \right)^{1/2} \right] (p_w - \sigma_{cy}) = \Delta\sigma_c \tag{45}$$

and $$\frac{qt_a}{2\pi e} = \frac{A_\phi d_0^{3/2}}{h^2} \left[ \left( 1 + \frac{h^2}{2d_0^2} \right) \int_{x_w}^{x_\sigma} \left( \ln \frac{a}{x} \right)^{1/4} x dx + \int_{x_\sigma}^{a} \left( \ln \frac{a}{x} \right)^{1/4} x dx \right] - \frac{2(x_\sigma^2 - x_w^2)\Delta\sigma_c}{E} \tag{46}$$

Equations (45) and (46) can be solved to obtain $$\Delta\sigma_c = \frac{E}{2(x_\sigma^2 - x_w^2)} \left\{ \frac{A_\phi d_0^{3/2}}{h^2} \left[ \left( 1 + \frac{h^2}{2d_0^2} \right) \int_{x_w}^{x_\sigma} \left( \ln \frac{a}{x} \right)^{1/4} x dx + \int_{x_\sigma}^{a} \left( \ln \frac{a}{x} \right)^{1/4} x dx \right] - \frac{qt_a}{2\pi e} \right\} \tag{47}$$

and $$d_x = 2^{3/2} e d_0 \left( \frac{p_w - \sigma_{cy}}{p_w - \sigma_{cy} - \Delta\sigma_c} \right)^2 \tag{48}$$

If ($2h < d_x < d_y$), equation (29) leads to solution (39) while equations (26) and (27) become equations (40) and (41), respectively.

In many circumstances, such as where the formation is shale (such as the Barnett Shale of North Texas), the fracture network may consist of a great number of parallel equally-spaced planar fractures whose spacing d is usually smaller than fracture height h. In other cases, the opposite is true. Both can lead to significant simplifications. An example is presented below.

Simplification of Model for Parallel Equally-Spaced Planar Fractures Whose Spacing $d_x$ and $d_y$ are Smaller than Fracture Height h The assumption that fracture spacing d is usually smaller than fracture height h leads to $$l_x = d_x$$

$$l_y = d_y. \tag{49}$$

Consequently, equations (11a) and (11b) can be simplified as $$A_{Ex} = \frac{1}{d_y}[2d_x + (d_y - 2d_x)H(d_y - 2d_x)], \tag{50a}$$

$$A_{Ey} = \frac{1}{d_x}[2d_y + (d_x - 2d_y)H(d_x - 2d_y)]. \tag{50b}$$

Equations (50a) and (50b) can be used to simplify equations (10a) and (10b) as follows $$w_x = \frac{2d_x d_y(p - \sigma_{cy})H(p - \sigma_{cy})}{[2d_x + (d_y - 2d_x)H(d_y - 2d_x)]E}, \tag{51a}$$

$$w_y = \frac{2d_y d_x(p - \sigma_{cx})H(p - \sigma_{cx})}{[2d_y + (d_x - 2d_y)H(d_x - 2d_y)]E}. \tag{51b}$$

Equations (50a) and (50b) can also be used to simplify equation (12) as follows $$\Delta\phi = \frac{2d_x(p - \sigma_{cy})H(p - \sigma_{cy})}{[2d_x + (d_y - 2d_x)H(d_y - 2d_x)]E} + \frac{2d_y(p - \sigma_{cx})H(p - \sigma_{cx})}{[2d_y + (d_x - 2d_y)H(d_x - 2d_y)]E}. \tag{52}$$

Equations (50a) and (50b) can be used to simplify equations (13a) and (13b) as follows $$k_x = k_{x0} + \frac{2d_x^3 d_y^2}{3[2d_x + (d_y - 2d_x)H(d_y - 2d_x)]^3 E^3}(p - \sigma_{cy})^3 H(p - \sigma_{cy}), \tag{53a}$$

$$k_y = k_{y0} + \frac{2d_y^3 d_x^2}{3[2d_y + (d_x - 2d_y)H(d_x - 2d_y)]^3 E^3}(p - \sigma_{cx})^3 H(p - \sigma_{cx}). \tag{53b}$$

These equations can be simplified in the following situations.

Situation I ($2d_x \geqq d_y \geqq d_c/2$)

With ($2d_x \geqq d_y \geqq d_x/2$), equations (50a) and (50b) become $$A_{Ex} = \frac{2d_x}{d_y}, \tag{54a}$$

$$A_{Ey} = \frac{2d_y}{d_x}. \tag{54b}$$

Furthermore, equations (51a) and (51b) become $$w_x = \frac{d_y(p - \sigma_{cy})H(p - \sigma_{cy})}{E}, \tag{55a}$$

$$w_y = \frac{d_x(p - \sigma_{cx})H(p - \sigma_{cx})}{E}. \tag{55b}$$

Furthermore, equation (52) becomes $$\Delta\phi = \frac{1}{E}(p - \sigma_{cy})H(p - \sigma_{cy}) + \frac{1}{E}(p - \sigma_{cx})H(p - \sigma_{cx}). \tag{56}$$

Furthermore, equations (53a) and (53b) become $$k_x = k_{x0} + \frac{d_y^2}{12E^3}(p - \sigma_{cy})^3 H(p - \sigma_{cy}), \tag{57a}$$

$$k_y = k_{y0} + \frac{d_x^2}{12E^3}(p - \sigma_{cx})^3 H(p - \sigma_{cx}). \tag{57b}$$

Furthermore, equations (24a) and (24b) become $$p - \sigma_{cy} = \frac{A_p}{d_y^{1/2}}\left(q\ln\frac{a}{x}\right)^{1/4}, \tag{58a}$$

$$p - \sigma_{cx} = \frac{e^{1/2}A_p}{d_x^{1/2}}\left(q\ln\frac{b}{y}\right)^{1/4}, \tag{58b}$$

where $$A_p\left[\frac{24E^3\mu}{(1+e)B}\right]^{1/4}. \tag{59}$$

Furthermore, equations (25a) and (25b) become $$p_w - \sigma_{cy} = \frac{A_p}{d_y^{1/2}}\left(q\ln\frac{a}{x_w}\right)^{1/4}, \tag{60a}$$

$$p_w - \sigma_{cx} = \frac{e^{1/2}A_p}{d_x^{1/2}}\left(q\ln\frac{ea}{x_w}\right)^{1/4}, \tag{60b}$$

And furthermore, equation (26) becomes $$\left[1 - \left(\frac{ed_y}{d_x}\right)^{1/2} A_{ea}\right](p_w - \sigma_{cy}) = \Delta\sigma_c. \tag{61}$$

Equation (60a) can be solved for $d_y$ as follows $$d_y = \frac{A_p^2}{(p_w - \sigma_{cy})^2}\left(q\ln\frac{a}{x_w}\right)^{1/2}. \tag{62}$$

With ($2d_x \geqq d_y \geqq d_x/2$), equations (27) and (28) become $$\frac{qt_a}{\pi} = \frac{eA_\phi}{2^{1/4}d_y^{1/2}}\left[2\int_{x_w}^{x_\sigma}\left(\ln\frac{a}{x}\right)^{1/4}x\,dx + \int_{x_\sigma}^{a}\left(\ln\frac{a}{x}\right)^{1/4}x\,dx\right] + \frac{2^{3/4}A_\phi}{e^{1/2}d_x^{1/2}}\int_{x_w}^{b}\left(\ln\frac{b}{y}\right)^{1/4}y\,dy + \frac{\Delta\sigma_c}{2E}\left[\frac{b^2-x_w^2}{e} - e(x_\sigma^2 - x_w^2)\right], \tag{63a}$$

$$\frac{qt_a}{\pi e} = \frac{2^{3/4}A_\phi}{d_y^{1/2}}\left[\int_{x_w}^{x_\sigma}\left(\ln\frac{a}{x}\right)^{1/4}x\,dx + \frac{1}{2}\int_{x_\sigma}^{a}\left(\ln\frac{a}{x}\right)^{1/4}x\,dx\right] + \frac{2^{3/4}A_\phi e^{1/2}}{d_x^{1/2}}\int_{x_w}^{a}\left(\ln\frac{a}{x}\right)^{1/4}x\,dx + \frac{\Delta\sigma_c(a^2-x_\sigma^2)}{2E}, \tag{63b}$$

and $$x_\sigma = a\exp\left[-\frac{d_y^2}{q}\left(\frac{\Delta\sigma_c}{A_p}\right)^4\right]. \tag{64}$$

Equations (61), (63) and (64) can be solved iteratively for $d_x$ and $\Delta\sigma_c$.

Situation II ($2d_x < d_y$)

With ($2d_y < d_y$), equations (50a) and (50b) become $$A_{Ex} = 1, \tag{65a}$$

$$A_{Ey} = \frac{2d_y}{d_x}. \tag{65b}$$

Furthermore, equations (51a) and (51b) become $$w_x = \frac{2d_x(p-\sigma_{cy})H(p-\sigma_{cy})}{E}. \tag{66a}$$

$$w_y = \frac{d_x(p-\sigma_{cx})H(p-\sigma_{cx})}{E}. \tag{66b}$$

Furthermore, equation (52) becomes $$\Delta\phi = \frac{2d_x}{d_yE}(p-\sigma_{cy})H(p-\sigma_{cy}) + \frac{1}{E}(p-\sigma_{cx})H(p-\sigma_{cx}). \tag{67}$$

Furthermore, equations (53a) and (53b) become $$k_x = k_{x0} + \frac{2d_x^3}{3d_yE^3}(p-\sigma_{cy})^3H(p-\sigma_{cy}), \tag{68a}$$

$$k_y = k_{y0} + \frac{d_x^2}{12E^3}(p-\sigma_{cx})^3H(p-\sigma_{cx}). \tag{68b}$$

Furthermore, equations (24a) and (24b) become $$p-\sigma_{cy} = \left(\frac{d_y}{8d_x^3}\right)^{1/4}A_p\left(q\ln\frac{a}{x}\right)^{1/4}, \tag{69a}$$

$$p-\sigma_{cx} = \frac{e^{1/2}A_p}{d_x^{1/2}}\left(q\ln\frac{b}{y}\right)^{1/4}, \tag{69b}$$

Furthermore, equations (25a) and (25b) become $$p_w-\sigma_{cy} = \left(\frac{d_y}{8d_x^3}\right)^{1/4}A_p\left(q\ln\frac{a}{x_w}\right)^{1/4}, \tag{70a}$$

$$p_w-\sigma_{cx} = \frac{e^{1/2}A_p}{d_x^{1/2}}\left(q\ln\frac{ea}{x_w}\right)^{1/4}, \tag{70b}$$

And furthermore, equation (26) becomes $$\left[1-\left(\frac{8e^2d_x}{d_y}\right)^{1/4}A_{ea}\right](p_w-\sigma_{cy}) = \Delta\sigma_c. \tag{71}$$

With ($2d_x < d_y$), equations (27) and (28) lead to $$\frac{qt_a}{\pi} = \frac{eA_\phi d_y^{1/4}}{2d_x^{3/4}}\left[\left(1+\frac{2d_x}{d_y}\right)\int_{x_w}^{x_\sigma}\left(\ln\frac{a}{x}\right)^{1/4}x\,dx + \frac{2d_x}{d_y}\int_{x_\sigma}^{a}\left(\ln\frac{a}{x}\right)^{1/4}x\,dx\right] + \frac{A_\phi}{2^{1/4}e^{1/2}d_x^{1/2}}\left(1+\frac{2d_x}{d_y}\right)\int_{x_w}^{b}\left(\ln\frac{b}{y}\right)^{1/4}y\,dy + \frac{\Delta\sigma_c}{2E}\left[\frac{2d_x}{ed_y}(b^2-x_w^2) - e(x_\sigma^2-x_w^2)\right], \tag{72a}$$

$$\frac{qt_a}{\pi e} = A_\phi\left(\frac{d_y}{d_x^3}\right)^{1/4}\left[\left(\frac{d_x}{d_y}+\frac{1}{2}\right)\int_{x_w}^{x_\sigma}\left(\ln\frac{a}{x}\right)^{1/4}x\,dx + \frac{d_x}{d_y}\int_{x_\sigma}^{a}\left(\ln\frac{a}{x}\right)^{1/4}x\,dx\right] + e^{1/2}A_\phi\frac{2^{3/4}}{d_x^{1/2}}\left(\frac{d_x}{d_y}+\frac{1}{2}\right)\int_{x_w}^{a}\left(\ln\frac{a}{x}\right)^{1/4}x\,dx + \frac{\Delta\sigma_c}{E}\left[\frac{d_x}{d_y}(a^2-x_w^2) - \frac{1}{2}(x_\sigma^2-x_w^2)\right], \tag{72b}$$

and $$x_\sigma = a\exp\left[-\frac{8d_x^3}{qd_y}\left(\frac{\Delta\sigma_c}{A_p}\right)^4\right]. \tag{73}$$

Equations (70), (71), (72) and (73) can be combined and solved iteratively for $d_x$, $d_y$ and $\Delta\sigma_c$.

Situation III ($d_y < d_x/2$)

With ($d_y < d_x/2$), equations (50a) and (50b) become $$A_{Ex} = \frac{2d_x}{d_y}, \tag{74a}$$

$$A_{Ey} = 1. \tag{74b}$$

Furthermore, equations (51a) and (51b) become $$w_x = \frac{d_y(p-\sigma_{cy})H(p-\sigma_{cy})}{E}, \tag{75a}$$

$$w_y = \frac{2d_y(p-\sigma_{cx})H(p-\sigma_{cx})}{E}. \tag{75b}$$

Furthermore, equation (52) becomes $$\Delta\phi = \frac{1}{E}(p-\sigma_{cy})H(p-\sigma_{cy}) + \frac{2d_y}{d_xE}(p-\sigma_{cx})H(p-\sigma_{cx}). \tag{76}$$

Furthermore, equations (53a) and (53b) become $$k_x = k_{x0} + \frac{d_y^2}{12E^3}(p-\sigma_{cy})^3H(p-\sigma_{cy}), \tag{77a}$$

$$k_y = k_{y0} + \frac{2d_y^3}{3d_xE^3}(p-\sigma_{cx})^3H(p-\sigma_{cx}). \tag{77b}$$

Furthermore, equations (24a) and (24b) become $$p-\sigma_{cy} = \frac{A_p}{d_y^{1/2}}\left(q\ln\frac{a}{x}\right)^{1/4}, \tag{78a}$$

$$p-\sigma_{cx} = e^{1/2}A_p\left(\frac{d_x}{8d_y^3}\right)^{1/4}\left(q\ln\frac{b}{y}\right)^{1/4}, \tag{78b}$$

Furthermore, equations (25a) and (25b) become $$p_w-\sigma_{cy} = \frac{A_p}{d_y^{1/2}}\left(q\ln\frac{a}{x_w}\right)^{1/4}, \tag{79a}$$

$$p_w-\sigma_{cx} = e^{1/2}A_p\left(\frac{d_x}{8d_y^3}\right)^{1/4}\left(q\ln\frac{ea}{x_w}\right)^{1/4}, \tag{79b}$$

And furthermore, equation (26) becomes $$\left[1-\left(\frac{e^2d_x}{8d_y}\right)^{1/4}A_{ea}\right](p_w-\sigma_{cy}) = \Delta\sigma_c. \tag{80}$$

With ($d_y<d_x/2$), equations (27) and (28) become $$\frac{qt_a}{\pi} = \frac{eA_\phi}{2^{1/4}d_y^{1/2}}\left[\begin{array}{c}\left(1+\frac{2d_y}{d_x}\right)\int_{x_w}^{x_\sigma}\left(\ln\frac{a}{x}\right)^{1/4}x\,dx + \\ \int_{x_\sigma}^{a}\left(\ln\frac{a}{x}\right)^{1/4}x\,dx\end{array}\right] + \frac{A_\phi d_x^{1/4}}{2e^{1/2}d_y^{3/4}}\left(1+\frac{2d_y}{d_x}\right)\int_{x_w}^{b}\left(\ln\frac{b}{y}\right)^{1/4}y\,dy + \frac{\Delta\sigma_c}{2E}\left(\frac{1}{e}(b^2-x_w^2)-\frac{2ed_y}{d_x}(x_\sigma^2-x_w^2)\right], \tag{81a}$$

$$\frac{qt_a}{\pi e} = A_\phi\frac{2^{3/4}}{d_y^{1/2}}\left[\begin{array}{c}\left(\frac{1}{2}+\frac{d_y}{d_x}\right)\int_{x_w}^{x_\sigma}\left(\ln\frac{a}{x}\right)^{1/4}x\,dx + \\ \frac{1}{2}\int_{x_\sigma}^{a}\left(\ln\frac{a}{x}\right)^{1/4}x\,dx\end{array}\right] + e^{1/2}A_\phi\left(\frac{d_x}{d_y^3}\right)^{1/4}\left(\frac{1}{2}+\frac{d_y}{d_x}\right)\int_{x_w}^{a}\left(\ln\frac{a}{x}\right)^{1/4}x\,dx + \frac{\Delta\sigma_c}{E}\left[\frac{1}{2}(a^2-x_w^2)-\frac{d_y}{d_x}(x_a^2-x_w^2)\right], \tag{81b}$$

and $$x_\sigma = a\exp\left[-\frac{d_y^2}{q}\left(\frac{\Delta\sigma_c}{A_p}\right)^4\right]. \tag{82}$$

Equations (79), (80), (81) and (82) can be combined and solved iteratively for $d_x$, $d_y$ and $\Delta\sigma_c$.

Figure 2:
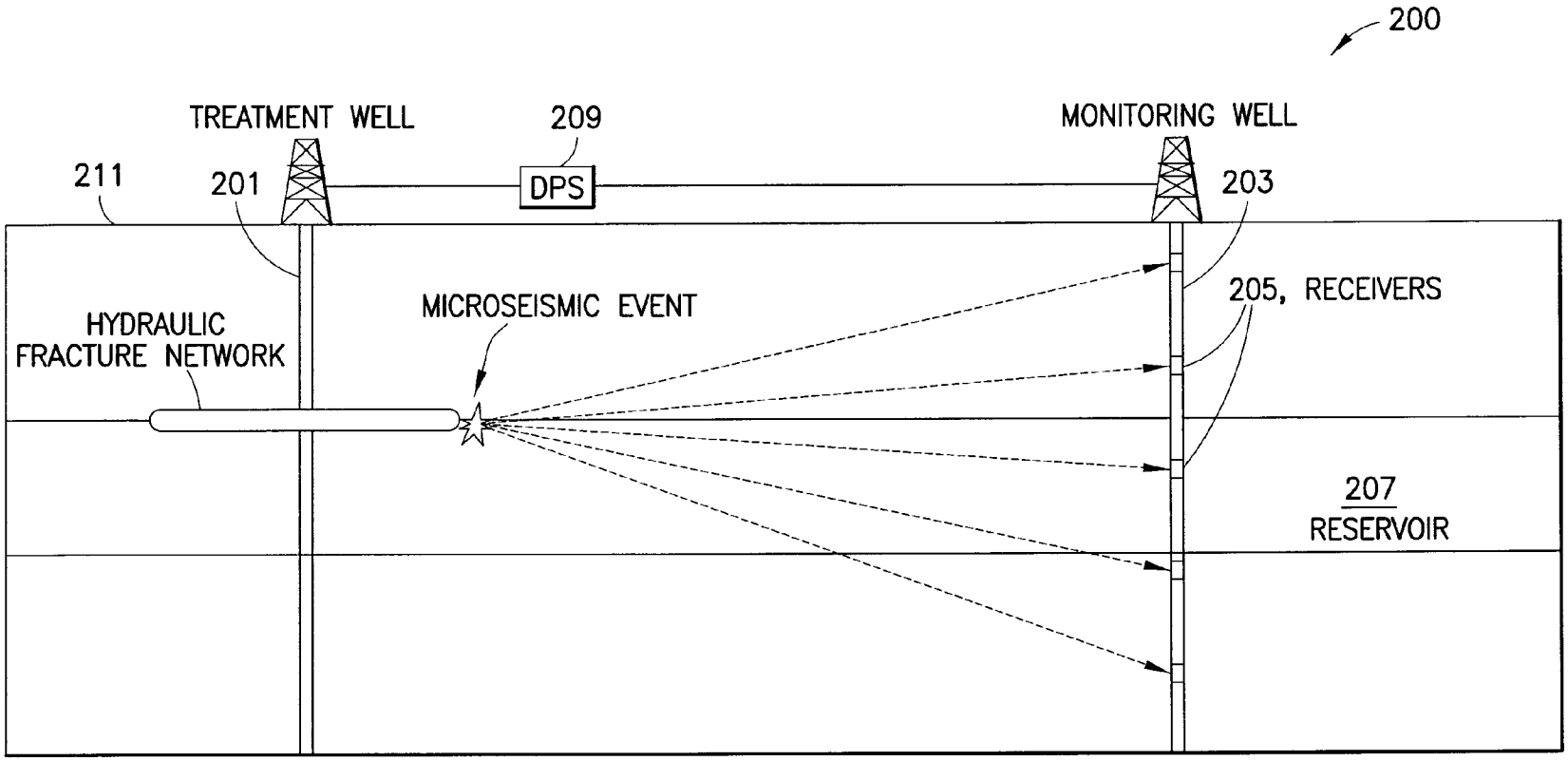
FIG. 2 is a schematic illustration of a hydraulic fracturing site that embodies the present invention.

FIG. 2 illustrates an exemplary operational setting for hydraulic fracturing of a subterranean formation (referred to herein as a "fracture site") in accordance with the present invention. The fracture site 200 can be located on land or in a water environment and includes a treatment well 201 extending into a subterranean formation as well as a monitoring well 203 extending into the subterranean formation and offset from the treatment well 201. The monitoring well 203 includes an array of geophone receivers 205 (e.g., three-component geophones) spaced therein as shown. During the fracturing operation, hydraulic fluid is pumped from the surface 211 into the treatment 201 causing the surrounding formation in a hydrocarbon reservoir 207 to fracture. Such fracturing produces microseismic events, which emit both compressional waves (also referred to as primary waves or P-waves) and shear waves (also referred to as secondary waves or S-waves) that propagate through the earth and are recorded by the geophone receiver array 205 of the monitoring well 203. The distance to the microseismic events can be calculated by measuring the difference in arrival times between the P-waves and the S-waves. Also, hodogram analysis, which examines the particle motion of the P-waves, can be used to determine azimuth angle to the event. The depth of the event is constrained by using the P- and S-wave arrival delays between receivers of the array 205. The distance, azimuth angle and depth values of such microseismic events can be used to derive a geometric boundary or profile of the fracturing caused by the hydraulic fluid over time, such as an elliptical boundary defined by a height h, elliptic aspect ratio e and major axis a as illustrated in FIG. 1.

The site 201 also includes a supply of hydraulic fluid and pumping means for supplying hydraulic fluid under high pressure to the treatment well 201. The hydraulic fluid can be stored with proppant (and possibly other special ingredients) pre-mixed therein. Alternatively, the hydraulic fluid can be stored without pre-mixed proppant or other special ingredients, and the proppant (and/or other special ingredients) mixed into the hydraulic fluid in a controlled manner by a process control system as described in U.S. Pat. No. 7,516,793, herein incorporated by reference in its entirety. The treatment well 201 also includes a flow sensor for measuring the pumping rate of the hydraulic fluid supplied to the treatment well and a downhole pressure sensor for measuring the downhole pressure of the hydraulic fluid in the treatment well 201.

Figure 3A:
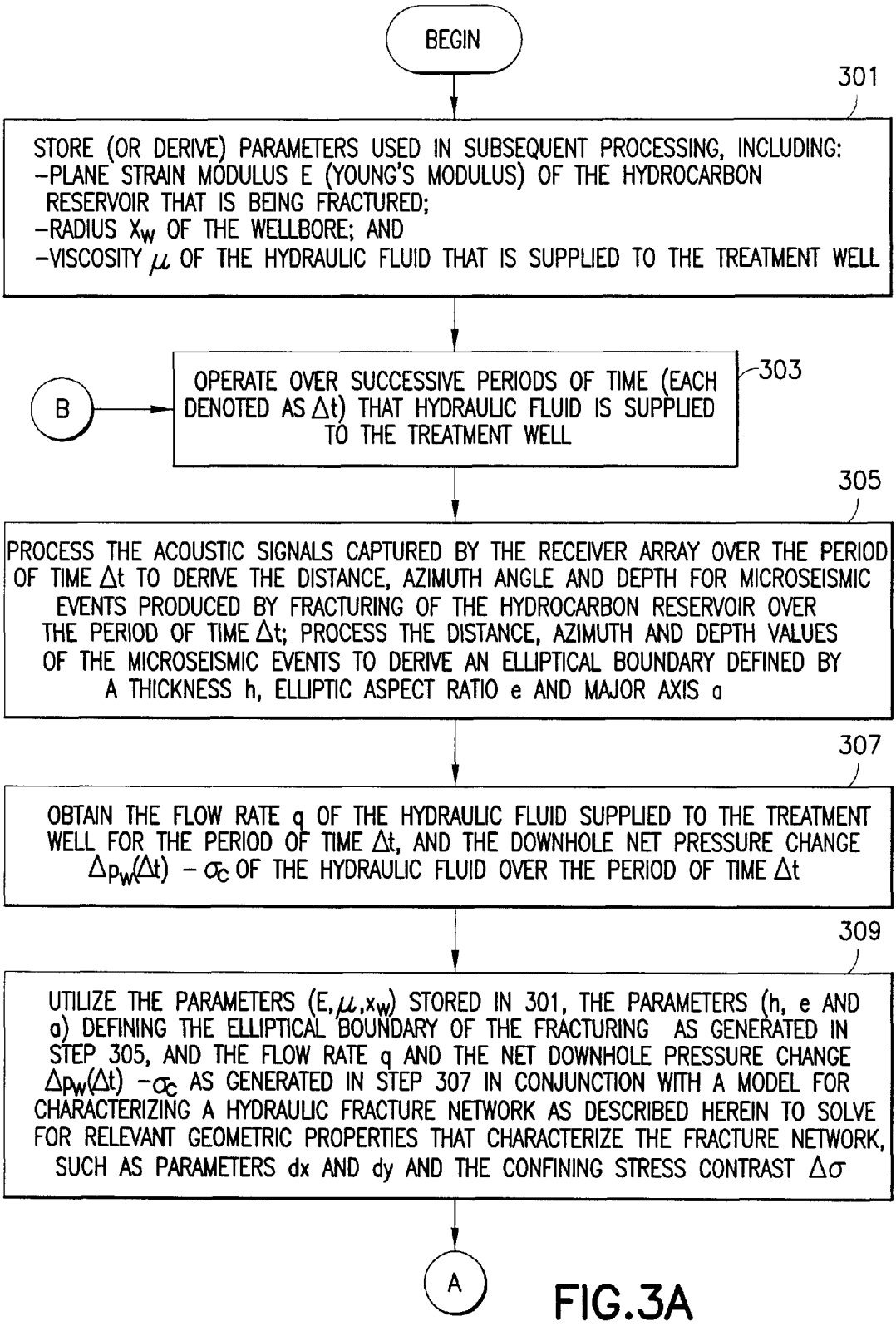
FIGS. 3A and 3B, collectively, is a flow chart illustrating operations carried out by the hydraulic fracturing site of FIG. 2 for fracturing treatment of the illustrative treatment well in accordance with the present invention.
Figure 3B:
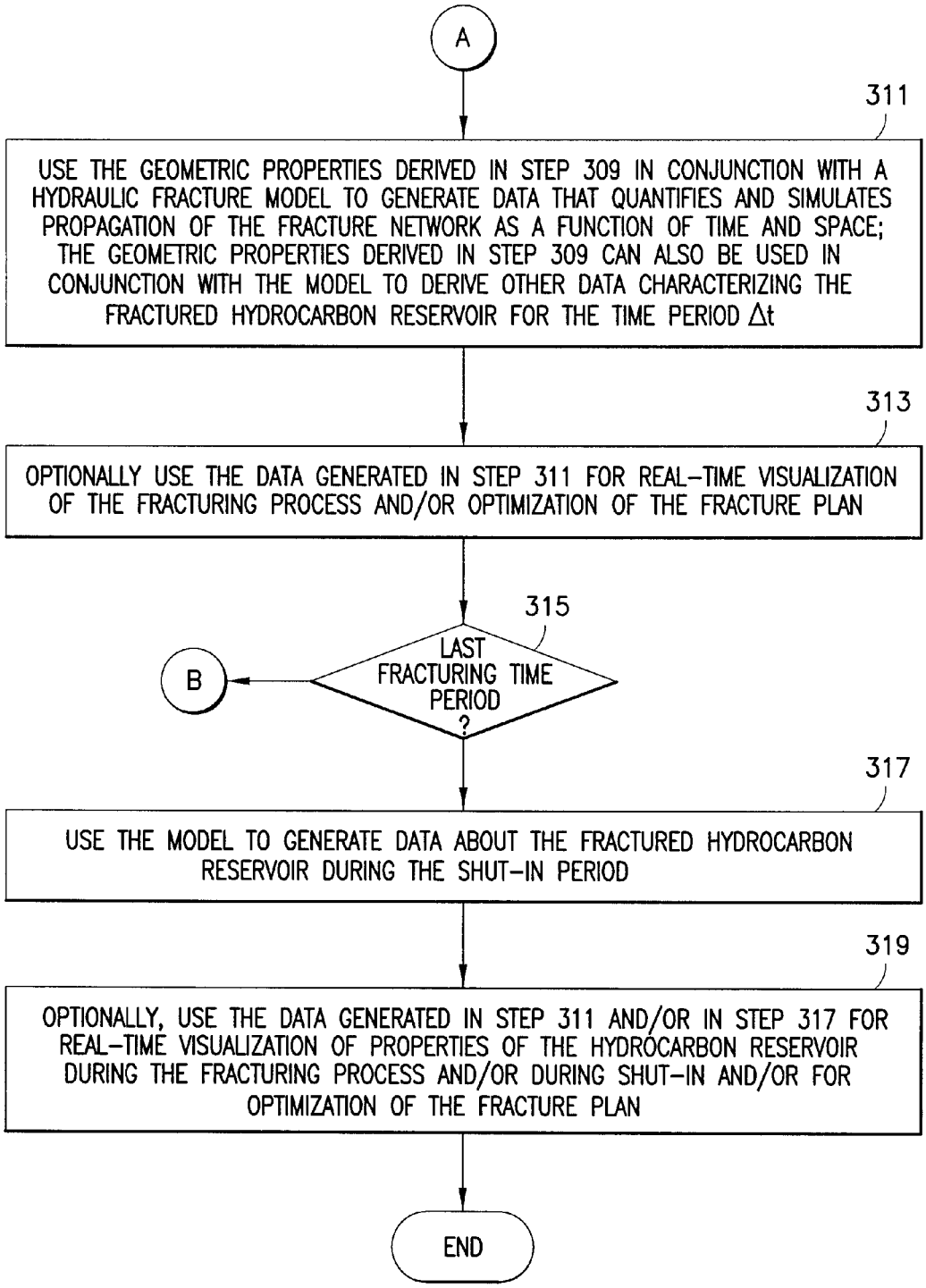
Figure 4A:
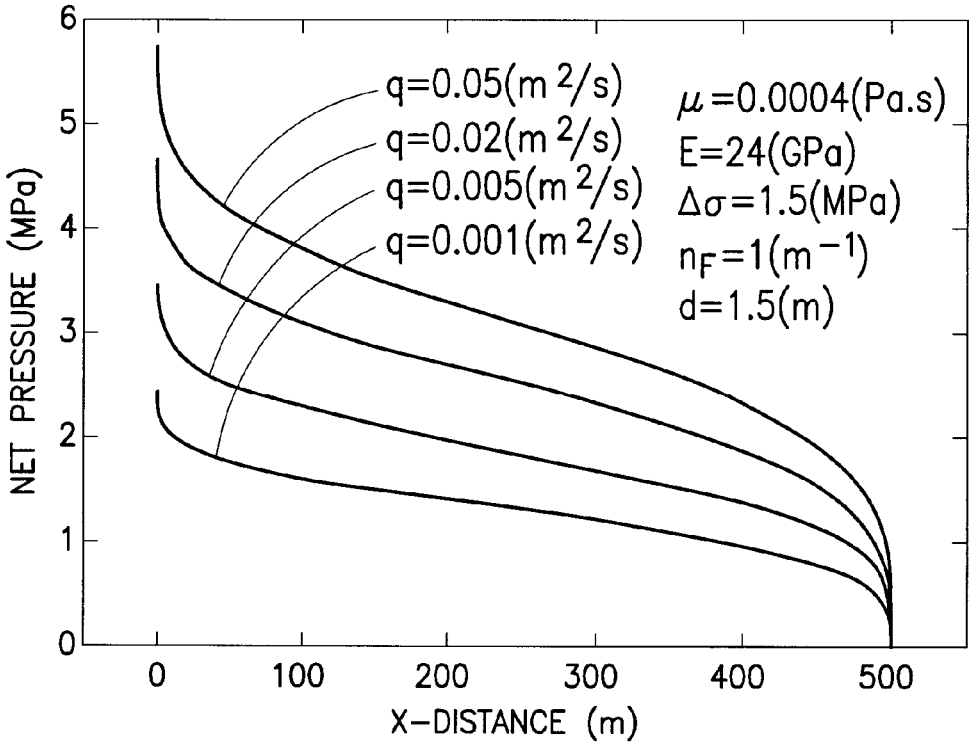
FIGS. 4A-4D depict exemplary display screens for visualizing properties of the treatment well and fractured hydrocarbon reservoir during the fracturing treatment of the illustrative treatment well of FIG. 2 in accordance with the present invention.
Figure 4B:
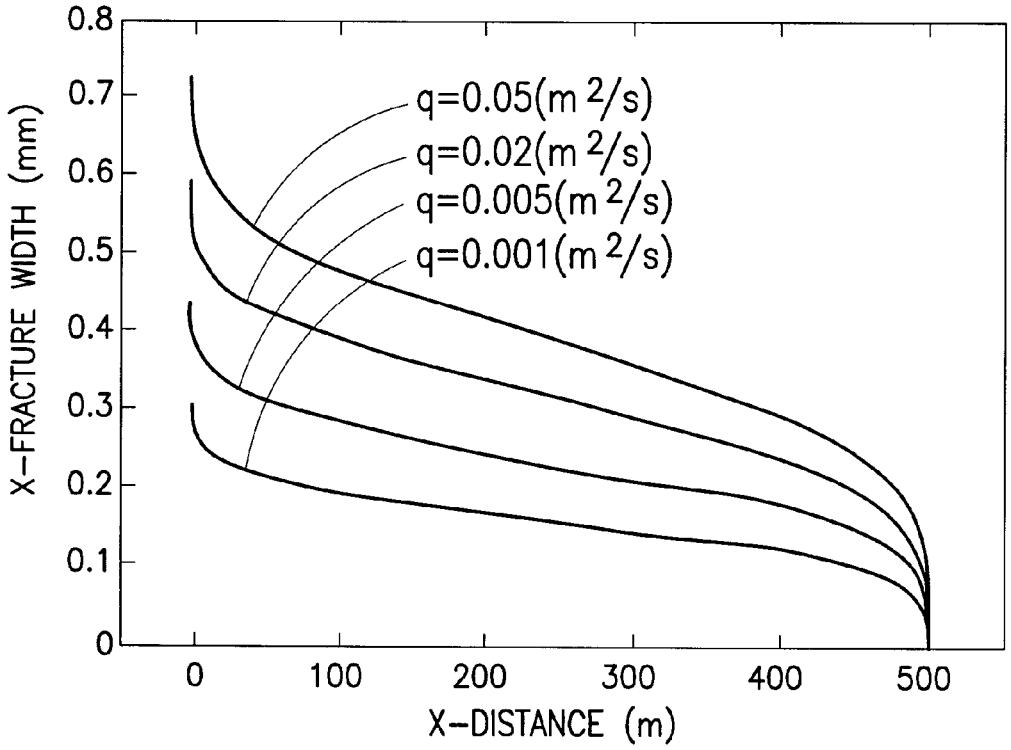
Figure 4C:
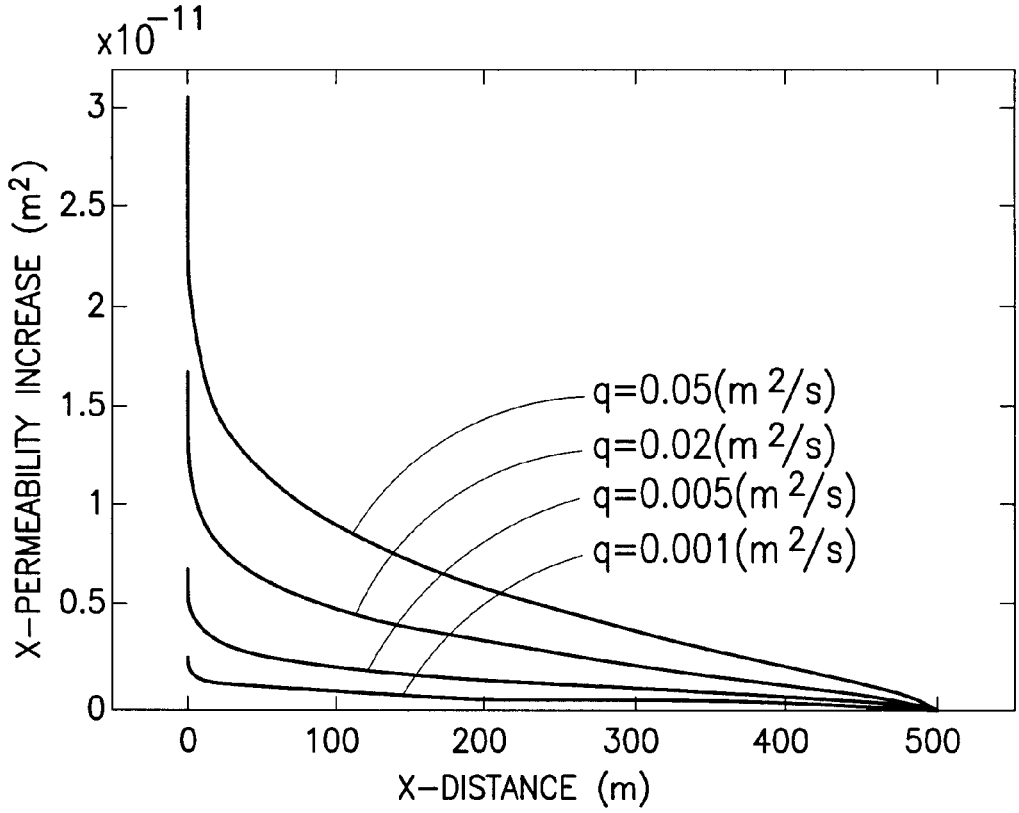
Figure 4D:
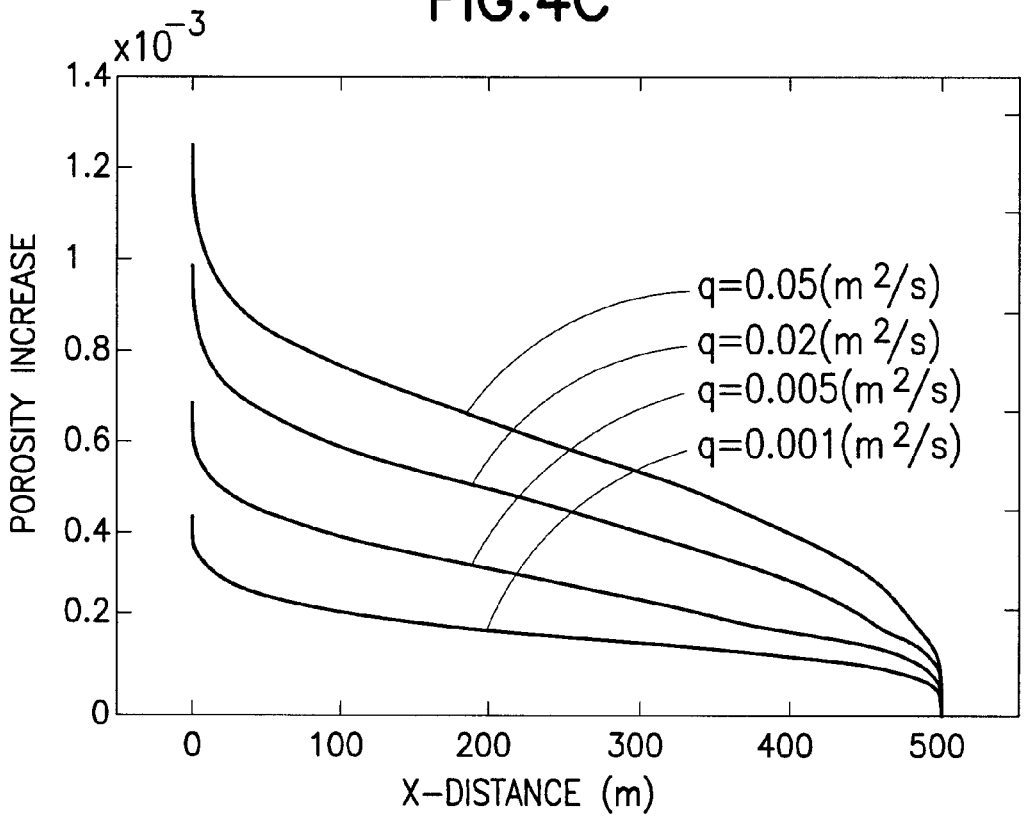

A data processing system 209 is linked to the receivers of the array 205 of the monitoring well 203 and to the flow sensor and downhole pressure sensor of the treatment well 201. The data processing system 209 carries out the processing set forth in FIG. 3 and described herein. As will be appreciated by those skilled in the art, the data processing system 209 includes data processing functionality (e.g., one or more microprocessors, associated memory, and other hardware and/or software) to implement the invention as described herein. The data processing system 209 can be realized by a workstation or other suitable data processing system located at the site 201. Alternatively, the data processing system 209 can be realized by a distributed data processing system wherein data is communicated (preferably in real time) over a communication link (typically a satellite link) to a remote location for data analysis as described herein. The data analysis can be carried out on a workstation or other suitable data processing system (such as a computer cluster or computing grid). Moreover, the data processing functionality of the present invention can be stored on a program storage device (e.g., one or more optical disks or other hand-holdable non-volatile storage apparatus, or a server accessible over a network) and loaded onto a suitable data processing system as needed for execution thereon as described herein.

In step 301, the data processing system 209 stores (or inputs from suitable measurement means) parameters used in subsequent processing, including the plain strain modulus E (Young's modulus) of the hydrocarbon reservoir 207 that is being fractured as well as the fluid viscosity ($\mu$) of the hydraulic fluid that is being supplied to the treatment well 201 and the radius ($x_w$) of the treatment wellbore.

In steps 303-311, the data processing system 209 is controlled to operate for successive periods of time (each denoted as $\Delta t$) that hydraulic fluid is supplied to the treatment well 201.

In step 305, the data processing system 209 processes the acoustic signals captured by the receiver array 205 over the period of time $\Delta t$ to derive the distance, azimuth angle and depth for the microseismic events produced by fracturing of the hydrocarbon reservoir 207 over the period of time $\Delta t$. The distance, azimuth and depth values of the microseismic events are processed to derive an elliptical boundary characterizing the profile of the fracturing caused by the hydraulic fluid over time. In the preferred embodiment, the elliptical boundary is defined by a height h, elliptic aspect ratio e and major axis a as illustrated in FIG. 1.

In step 307, the data processing system 209 obtains the flow rate q, which is the pumping rate divided by the height of the elliptic fractured formation, of the hydraulic fluid supplied to the treatment well for the period of time $\Delta t$, and derives the net downhole pressure $p_w-\sigma_c$ of the hydraulic fluid at the end of the period of time $\Delta t$. The wellbore net pressure $p_w-\sigma_c$ can be obtained from the injection pressure of the hydraulic fluid at the surface according to the following:

$$p_w-\sigma_c=p_{surface}-\text{BHTP}-p_{pipe}-p_{perf}+p_{hydrostatic} \tag{83}$$

where $p_{surface}$ is the injection pressure of the hydraulic fluid at the surface;

BHTP is the bottom hole treating pressure;

$p_{pipe}$ is the friction pressure of the tubing or casing of the treatment well while the hydraulic fluid is being injected into the treatment well; this friction pressure depends on the type and viscosity of the hydraulic fluid, the size of the pipe and the injection rate;

$p_{perf}$ is the friction pressure through the perforations of the treatment well that provide for injection of the hydraulic fluid into the reservoir; and $p_{hydrostatic}$ is the hydrostatic pressure due to density of the hydraulic fluid column in the treatment well.

The wellbore net pressure $p_w-\sigma_c$ can also be derived from BHTP at the beginning of treatment and the injection pressure $p_{surface}$ at the beginning of the shut-in period. The wellbore net pressure $p_w-\sigma_c$ at the end of treatment can be calculated by pluggin these values into equation (83) while neglecting both friction pressures $p_{pipe}$ and $p_{perf}$, which are zero during the shut-in period.

In step 309, the data processing system 209 utilizes the parameters (E, $\mu$, $x_w$) stored in 301, the parameters (h, e and a) defining the elliptical boundary of the fracturing as generated in step 305, and the flow rate q, the pumping period $t_p$ and the net downhole pressure $p_w-\sigma_c$ as generated in step 307 in conjunction with a model for characterizing a hydraulic fracture network as described herein to solve for relevant geometric properties that characterize the hydraulic fracture network at the end of the time period $\Delta t$, such as parameters $d_x$ and $d_y$ and the stress contrast $\Delta\sigma_c$ as set forth above.

In step 311, the geometric and geomechanical properties (e.g., $d_x$, $d_y$, $\Delta\sigma_c$) that characterize the hydraulic fracture network as generated in step 309 are used in conjunction with a model as described herein to generate data that quantifies and simulates propagation of the fracture network as a function of time and space, such as width w of the hydraulic fractures from equations (10a) and (10b) and the times needed for the front and tail of the fracturing formation, as indicated by the distribution of induced microseismic events, to reach certain distances from equation (19). The geometric and geomechanical properties generated in step 309 can also be used in conjunction with the model to derive data characterizing the fractured hydrocarbon reservoir at the time period $t_p$, such as net pressure of hydraulic fluid in the treatment well (from equations (17a) and (17b), or (25a) and (25b)), net pressure inside the fractures (from equations (16a) and (16b), or (24a) and (24b)), change in fracture porosity ($\Delta\phi$ from equation 12), and change in fracture permeability ($k_x$ and $k_y$ from equations (13a) and (13b)).

In optional step 313, the data generated in step 311 is used for real-time visualization of the fracturing process and/or optimization of the fracturing plan. Various treatment scenarios may be examined using the forward modeling procedure described below. In general, once certain parameters such as the fracture spacing and the stress difference have been determined, one can adjust the other parameters to optimize a treatment. For instance, the injection rate and the viscosity or other properties of hydraulic fluid may be adjusted to accommodate desired results. Exemplary display screens for real-time visualization of net pressure change of hydraulic fluid in the treatment well along the x-axis, fracture width w along the x-axis, changes in porosity and permeability along the x-axis are illustrated in FIGS. 4A, 4B, 4C and 4D.

In step 315, it is determined if the processing has been completed for the last fracturing time period. If not, the operations return to step 303 to repeat the operations of step 305-313 for the next fracturing time period. If so, the operations continue to step 317.

In step 317, the model as described herein is used to generate data that quantifies and simulates propagation of the fracture network as a function of time and space during the shut-in period, such as width w of hydraulic fractures and the distance of the front and tail of the fracturing formation over time. The model can also be used to derive data characterizing the fractured hydrocarbon reservoir during the shut-in period, such as net pressure of hydraulic fluid in the treatment well (from equations (17a) and (17b), or (25a) and (25b)), net pressure inside the fractures (from equations (16a) and (16b), or (24a) and (24b)), change in fracture porosity ($\Delta\phi$ from equation 12), and change in fracture permeability ($k_x$ and $k_y$ from equations (13a) and (13b)).

Figure 5A:
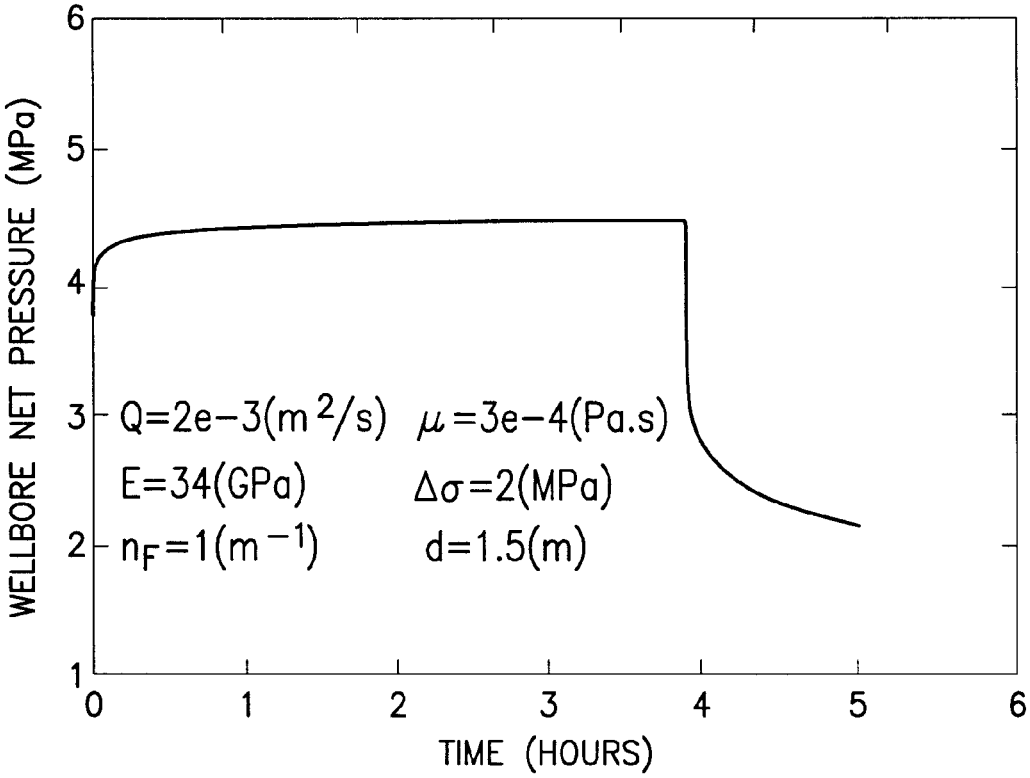
FIGS. 5A-5D depict exemplary display screens for visualizing properties of the treatment well and fractured hydrocarbon reservoir during the fracturing treatment and during a subsequent shut-in period of the illustrative treatment well of FIG. 2 in accordance with the present invention.
Figure 5B:
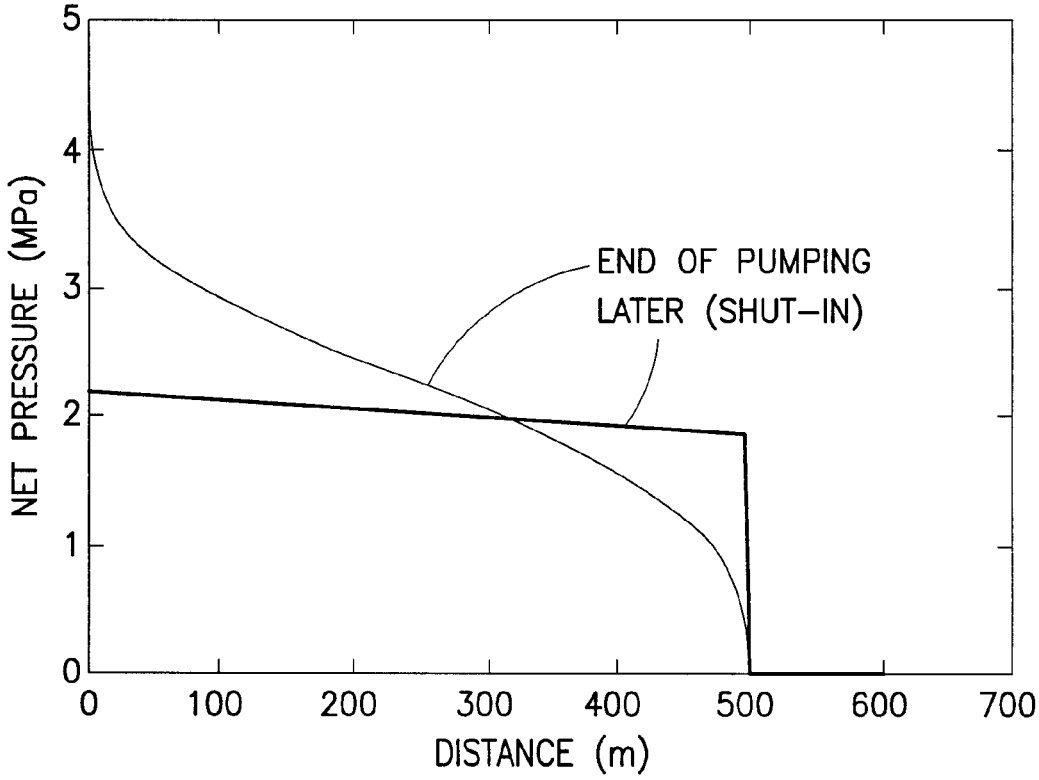
Figure 5C:
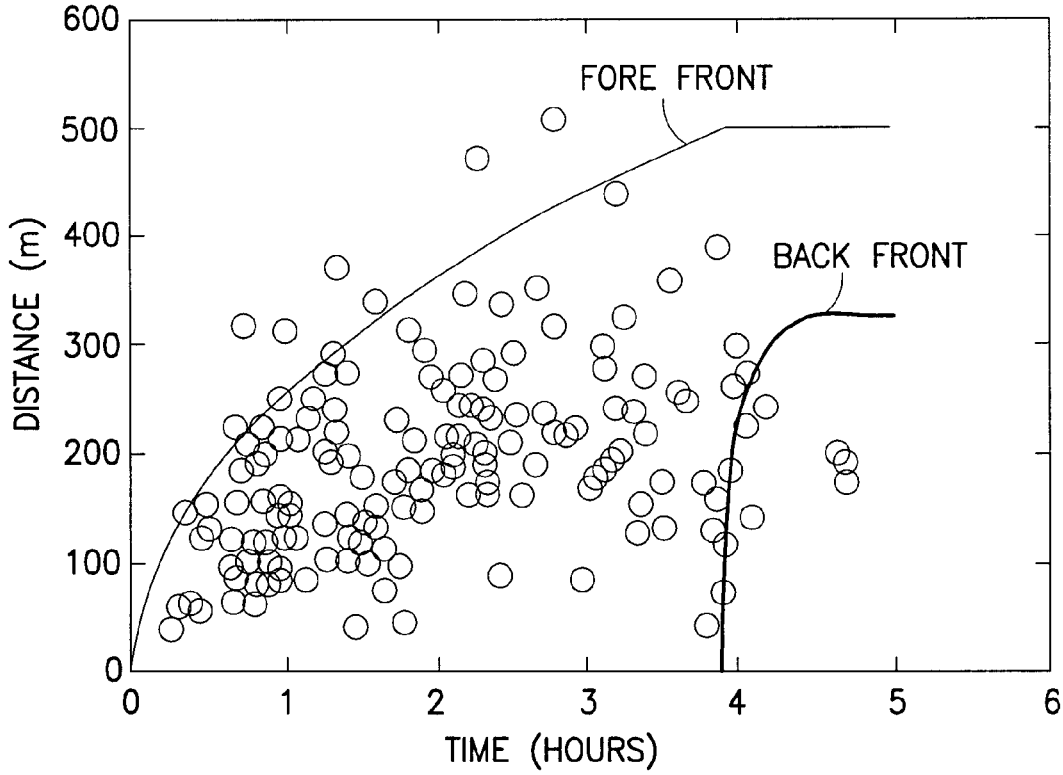
Figure 5D:
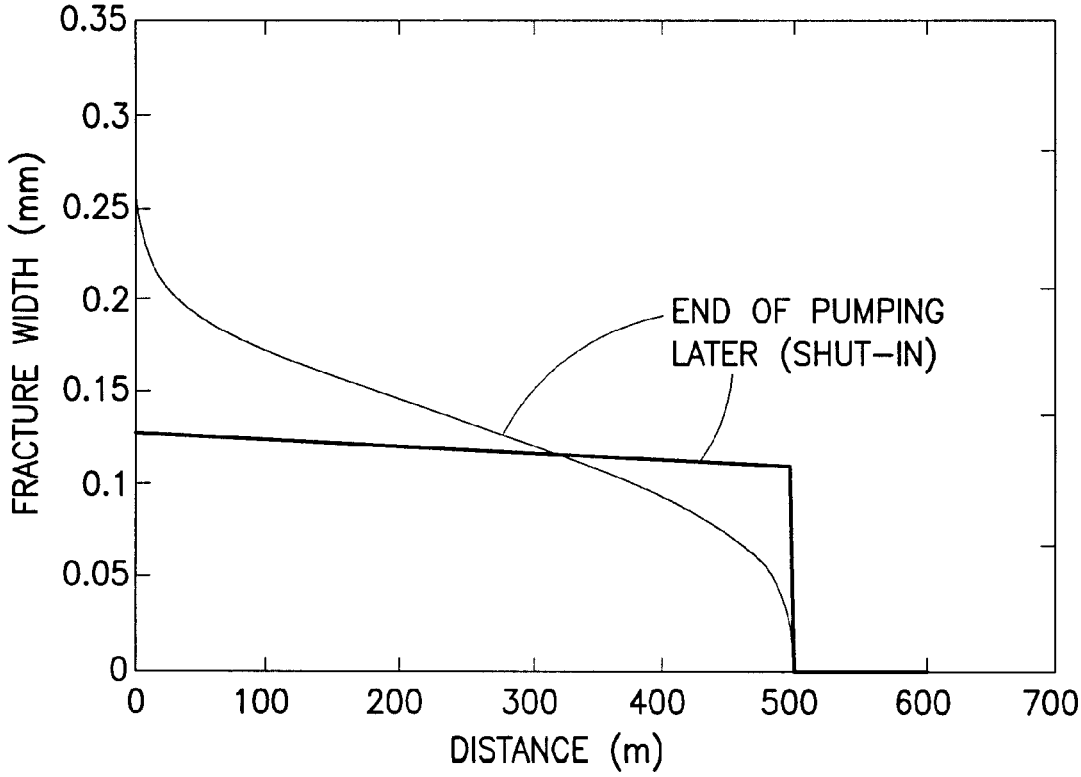

Finally, in optional step 319, the data generated in step 311 and/or the data generated in step 317 is used for real-time visualization of the fracturing process and/or shut-in period after fracturing and/or optimization of the fracture plan. FIGS. 5A, 5B, 5C, and 5D illustrate exemplary display screens for real-time visualization of net pressure of hydraulic fluid in the treatment well as a function of time during the fracturing process and then during shut-in (which begins at the time of 4 hours), net pressure inside the fractures as a function of distance at a time at the end of fracturing and at a time during shut-in, the distance of the front and tail of the fracturing formation over time during the fracturing process and then during shut-in, fracture width as a function of distance at a time at the end of fracturing and at a time during shut-in, respectively. Note that the circles of FIG. 5C represent locations of microseismic events as a function of time and distance away from the treatment well during the fracturing process and then during shut-in.

The hydraulic fracture model as described herein can be used as part of forward calculations to help in the design and planning stage of a hydraulic fracturing treatment. More particularly, for a given the major axis $a=a_i$ at time $t=t_i$, calculations can be done according to the following procedure:

1. assume $$\frac{\partial \phi}{\partial t}$$

if $t=t_0$ (i=0), otherwise 2. knowing $$\frac{\partial \phi}{\partial t}$$

from $t=t_{i-1}$, determine e using equation (18)

3. knowing $$\frac{\partial \phi}{\partial t}$$

and e, calculate $p-\sigma_{cx}$ and $p-\sigma_{cy}$ using equations (15a) and (15b) or equations (16a) and (16b)

4. knowing $p-\sigma_{cx}$ and $p-\sigma_{cy}$, calculate $\Delta\phi$ using equation (12)
5. knowing e and $\Delta\phi$, calculate $t=t_i$ using equations (19), or (27) and (28)
6. knowing $\Delta t=t_i-t_{i-1}$ and $\Delta\phi$, calculate $$\frac{\partial \phi}{\partial t}$$

as $\Delta\phi/\Delta t$ 7. repeat steps 2 to 6 till the whole calculation process converges Carrying out the procedure described above for i=1 to N simulates the propagation of an induced fracture network till front location $a=a_N$. Distributions of net pressure, fracture width, porosity and permeability as functions of space and time for $x<a_N$ and $t<t_N$ are obtained as well.

Advantageously, the hydraulic fracture model and fracturing process based thereon constrains geometric and geomechanical properties of the hydraulic fractures of the subterranean formation using the field data in a manner that significantly reduces the complexity of the fracture model and thus significantly reduces the processing resources and time required to provide accurate characterization of the hydraulic fractures of the subterranean formation. Such characterization can be generated in real-time to manually or automatically manipulate surface and/or down-hole physical components supplying hydraulic fluids to the subterranean formation to adjust the hydraulic fracturing process as desired, such as by optimizing fracturing plan for the site (or for other similar fracturing sites).

There have been described and illustrated herein a methodology and systems for monitoring hydraulic fracturing of a subterranean hydrocarbon formation and extension thereon. While particular embodiments of the invention have been described, it is not intended that the invention be limited thereto, as it is intended that the invention be as broad in scope as the art will allow and that the specification be read likewise. Thus, while seismic processing is described for defining a three-dimensional boundary of the fractured formation produced by the hydraulic fracturing treatment, other suitable processing mechanisms such as tilt meters and the like can be used. Also, while particular hydraulic fracture models and assumptions for deriving such models have been disclosed, it will be appreciated that other hydraulic fracture models and assumptions could be utilized. It will therefore be appreciated by those skilled in the art that yet other modifications could be made to the provided invention without deviating from its spirit and scope as claimed.

What is claimed is:

1. A method for fracturing a hydrocarbon formation accessible by a treatment well extending into the hydrocarbon formation, the method comprising:

(a) supplying hydraulic fluid to the treatment well to produce fractures in a hydrocarbon formation;

(b) obtaining and processing field data obtained during (a);

(c) processing the field data to solve for geometric and geomechanical properties of a complex fracture network representing fractures in the hydrocarbon formation produced during (a);

(d) processing the geometric and geomechanical properties derived in (c) in conjunction with a fracture model to generate data that characterizes fractures in the hydrocarbon formation produced during (a), wherein the fracture model includes a height, a major axis and an aspect ratio of an elliptical boundary defined by fracturing in the hydrocarbon formation; and (e) outputting the data generated in (d) to a user;

wherein the fracture model represents two perpendicular sets of parallel planar fractures along an x-axis and y-axis, respectively, wherein fractures parallel to the x-axis are equally separated by distance $d_y$, wherein fractures parallel to the y-axis are separated by distance $d_x$, and wherein the formation has plane strain modulus E and applies confining stresses $\sigma_{cx}$, $\sigma_{cy}$ along the x-axis and y-axis, respectively; and wherein the distances $d_x$, $d_y$, and a stress contrast $\Delta\sigma_c$ representing the difference between the confining stresses $\sigma_{cx}$, $\sigma_{cy}$ are solved according to a set of equations involving the height h, the major axis a and the aspect ratio e of the elliptical boundary defined by fracturing in the hydrocarbon formation as well as at least one treatment parameter associated with the hydraulic fluid supplied to the treatment well, the at least one treatment parameter selected from the group consisting of a time period of treatment, a wellbore radius, a wellbore net pressure, a flow rate, a viscosity, and at least one non-Newtonian fluid parameter.

2. A method according to claim 1, wherein:

the outputting of (e) comprises generating a display screen for visualizing the data generated in (d).

3. A method according to claim 1, wherein:

the geometric properties of the complex fracture network include at least one parameter representing distance between fractures for a number of fracture sets.

4. A method according to claim 1, wherein:

the geomechanical properties of the hydrocarbon formation include at least one parameter representing the plane strain modulus and at least one parameter representing confining stresses on the fractures.

5. A method according to claim 1, wherein:

the fracture model includes at least one treatment parameter associated with the hydraulic fluid supplied to the treatment well, the at least one treatment parameter selected from the group consisting of a time period of treatment, a wellbore radius, a wellbore net pressure, a flow rate, a viscosity, and at least one non-Newtonian fluid parameter.

6. A method according to claim 1, further comprising:

processing field data to define a height, major axis and aspect ratio of an elliptical boundary of the fracturing in the hydrocarbon formation for use in said fracture model.

7. A method according to claim 1, wherein:

field data comprises data that represents microseismic events produced by the fracturing in the hydrocarbon formation and detected by receivers in a monitoring well adjacent the treatment well.

8. A method according to claim 1, wherein:

the set of equations are dictated by constraint conditions related to the distances $d_x$, $d_y$, and the stress contrast $\Delta\sigma_c$.

9. A method according to claim 1, wherein:

the operations of (a), (b), (c) and (d) are carried out over successive time periods to generate data characterizing fractures in the hydrocarbon formation over time.

10. A method according to claim 9, wherein:

the data generated in d) quantifies propagation of fractures in the hydrocarbon formation over time.

11. A method according to claim 10, wherein:

the data generated in d) represents width of the fractures over time.

12. A method according to claim 10, wherein:

the data generated in d) represents distances of a front and tail of a fracturing formation over time.

13. A method according to claim 9, wherein:

the data generated in d) represents net pressure change of hydraulic fluid in the treatment well over time.

14. A method according to claim 9, wherein:

the data generated in d) represents net pressure change inside fractures over time.

15. A method according to claim 9, wherein:

the data generated in d) represents a change in porosity of the fractured hydrocarbon formation over time.

16. A method according to claim 9, wherein:

the data generated in d) represents change in permeability of the fractured hydrocarbon formation over time.

17. A method according to claim 1, further comprising:

(f) during a shut-in period, shutting down the supply of hydraulic fluid to the treatment well;

(g) using the model to generate data that characterizes fractures in the hydrocarbon formation produced during (f); and (h) outputting the data generated in (g) to a user for monitoring the fracturing of the treatment well.

18. A method according to claim 17, wherein:

the data generated in g) quantifies propagation of fractures in the hydrocarbon formation over time during at least a portion of the shut-in period.

19. A method according to claim 18, wherein:

the data generated in g) represents width of the fractures over time during at least a portion of the shut-in period.

20. A method according to claim 18, wherein:

the data generated in g) represents distances of a front and tail of a fracturing formation over time during at least a portion of the shut-in period.

21. A method according to claim 17, wherein:

the data generated in g) represents net pressure change of hydraulic fluid in the treatment well over time during at least a portion of the shut-in period.

22. A method according to claim 17, wherein:

the data generated in g) represents net pressure change inside fractures over time during at least a portion of the shut-in period.

23. A method according to claim 17, wherein:

the data generated in g) represents a change in porosity of the fractured hydrocarbon formation over time during at least a portion of the shut-in period.

24. A method according to claim 17, wherein:

the data generated in g) represents change in permeability of the fractured hydrocarbon formation over time during at least a portion of the shut-in period.

25. A method according to claim 1, wherein:

the data generated in d) is used as part of forward calculations for design and planning of a hydraulic fracturing treatment.

26. A method according to claim 25, wherein:

the forward calculations are used to adjust at least one property of the hydraulic fluid supplied to the treatment well.

27. A method according to claim 26, wherein:

the at least one property is selected from the group consisting of injection rate and viscosity.

28. A program storage device being non-transitory, and readable by a computer processing machine, tangibly embodying computer instructions to perform the method of claim 1.

29. A data processing system for use in fracturing a hydrocarbon formation accessible by a treatment well extending into the hydrocarbon formation, the data processing system comprising:

(a) means for obtaining and processing field data obtained during production of fractures in the hydrocarbon formation, wherein in the processing of the field data solves for geometric and geomechanical properties of a complex fracture network representing fractures in the hydrocarbon formation;

(b) means for processing the geometric and geomechanical properties in conjunction with a fracture model to generate data that characterizes fractures in the hydrocarbon formation, wherein the fracture model includes a height, a major axis and an aspect ratio of an elliptical boundary defined by fracturing in the hydrocarbon formation; and (c) means for outputting the data that characterizes fractures in the hydrocarbon formation to a user;

wherein the fracture model represents two perpendicular sets of parallel planar fractures along an x-axis and y-axis, respectively, wherein fractures parallel to the x-axis are equally separated by distance $d_y$, wherein fractures parallel to the y-axis are separated by distance $d_x$, and wherein the formation applies confining stresses $\sigma_{cx}$, $\sigma_{cy}$ parallel to the x-axis and y-axis, respectively; and wherein the distances $d_x$, $d_y$, and a stress contrast $\Delta\sigma_c$ representing the difference between the confining stresses $\sigma_{cx}$, $\sigma_{cy}$ are solved according to a set of equations involving the height h, the major axis a and the aspect ratio e of the elliptical boundary defined by fracturing in the hydrocarbon formation as well as at least one treatment parameter associated with hydraulic fluid supplied to the treatment well, the at least one treatment parameter selected from the group consisting of a time period of treatment, a wellbore radius, a wellbore net pressure, a flow rate, a viscosity, and at least one non-Newtonian fluid parameter.

30. A data processing system according to claim 29, wherein:

the means for outputting generates a display screen for visualizing the data that characterizes fractures in the hydrocarbon formation.

31. A data processing system according to claim 29, wherein:

the geometric properties of the complex fracture network include at least one parameter representing distance between fractures for a number of fracture sets.

32. A data processing system according to claim 29, wherein:

the geomechanical properties of the hydrocarbon formation include at least one parameter representing plane strain modulus E and at least one parameter representing confining stresses on the fractures.

33. A data processing system according to claim 29, wherein:

the fracture model includes at least one treatment parameter associated with the hydraulic fluid supplied to the treatment well, the at least one treatment parameter selected from the group consisting of a time period of treatment, a wellbore radius, a wellbore net pressure, a flow rate, a viscosity, and at least one non-Newtonian fluid parameter.

34. A data processing system according to claim 29, further comprising:

means for processing field data to define a height, major axis and aspect ratio of an elliptical boundary of the fracturing in the hydrocarbon formation for use in said fracture model.

35. A data processing system according to claim 34, wherein:

said field data comprises data that represents microseismic events produced by the fracturing in the hydrocarbon formation and detected by receivers in a monitoring well adjacent the treatment well.

36. A data processing system according to claim 29, wherein:

the set of equations are dictated by constraint conditions related to the distances $d_y$, $d_y$, and the stress contrast $\Delta\sigma_c$.

37. A data processing system according to claim 29, wherein:

the means of (a), (b), and (c) operate over successive time periods to generate data characterizing fractures in the hydrocarbon formation over time.

* * * * *